US006180324B1

(12) United States Patent
Uehara

(10) Patent No.: US 6,180,324 B1
(45) **Date of Patent: *Jan. 30, 2001**

(54) HEAT DEVELOPABLE COLOR PHOTOGRAPHIC MATERIAL AND IMAGE-FORMING SYSTEM USING THE SAME

(75) Inventor: Kazuki Uehara, Minami Ashigara (JP)

(73) Assignee: Fuji Photo Film Co., Ltd., Minami-Ashigara (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/216,921

(22) Filed: Dec. 21, 1998

(30) Foreign Application Priority Data

Dec. 25, 1997 (JP) ..... 9-357606
Mar. 13, 1998 (JP) ..... 10-063264
Jun. 23, 1998 (JP) ..... 10-176228

(51) Int. Cl.[7] ..... G03C 7/26; G03C 8/10; G03C 8/40

(52) U.S. Cl. ..... 430/353; 430/203; 430/222; 430/223; 430/225; 430/226; 430/235; 430/505; 430/509; 430/543; 430/559; 430/562

(58) Field of Search ..... 430/353, 223, 430/203, 225, 226, 235, 505, 543, 509, 559, 562, 222

(56) References Cited

U.S. PATENT DOCUMENTS 4,783,396 11/1988 Nakamura et al. .
5,817,452 10/1998 Kamosaki .

FOREIGN PATENT DOCUMENTS

0620490A1 10/1994 (EP) .
0652114A1 5/1995 (EP) .

*Primary Examiner*—Thorl Chea
(74) *Attorney, Agent, or Firm*—Birch, Stewart, Kolasch & Birch, LLP.

(57) ABSTRACT

A heat developable color photographic material for use in an image-forming process comprising: (a) superposing a heat developable color photographic material onto an image-receiving material that is formed on a separate support from a support of the heat developable color photographic material; and (b) heat-developing the heat developable color photographic material superposed on the image-receiving material to form or release a diffusible dye, so that the diffusible dye is transferred to the image-receiving material to thereby form an image: wherein the heat developable color photographic material contains at least a light-sensitive silver halide and yellow, magenta and cyan dye-donating compounds, which form or release diffusible yellow, magenta and cyan dyes, respectively, by heat development corresponding to silver development, wherein the yellow, magenta and cyan dyes, respectively, has a maximum absorption intensity of spectral absorption at a wavelength of from 440 nm to 460 nm, from 525 nm to 545 nm, and from 610 nm to 640 nm, and wherein the heat developable color photographic material further contains at least one specific compound represented by the following formula (I) other than the above dye-donating compounds:

$$\mathrm{PWR}-(\mathrm{Time})_t-\mathrm{Dye}. \qquad \text{(I)}$$

11 Claims, 2 Drawing Sheets

HEAT DEVELOPABLE COLOR PHOTOGRAPHIC MATERIAL AND IMAGE-FORMING SYSTEM USING THE SAME

FIELD OF THE INVENTION

The present invention relates to an image-forming system comprising superposing a heat developable color photographic material (hereinafter referred to as "light-sensitive element") onto an image-receiving material provided on a different support, and forming an image by transferring a diffusible dye. The heat developable color photographic material contains at least light-sensitive silver halide and a dye-donating compound. Further, an image obtained by the heat developable color photographic material and the image-receiving material according to the present invention is mainly used as a color-proof in the printing field.

BACKGROUND OF THE INVENTION

Heat developable photographic materials are well-known and heat developable photographic materials and processes for using such photographic materials are disclosed, for example, in "Shashin Kogaku no Kiso, Hi-Gin-En Shashin-Hen (The Elementary Course of Photographic Engineering, Section of Nonsilver Photography)", pp. 242 to 255, Corona Publishing Co. (1982), and U.S. Pat. No. 4,500,626, etc.

A method of imagewise forming or releasing diffusible dyes by heat development and transferring these diffusible dyes to an image-receiving material has been proposed. In this method, a negative dye image and a positive dye image can be obtained by changing the kind of the dye-donating compound and the kind of silver halide to be used. Further details are disclosed in U.S. Pat. Nos. 4,500,626, 4,483,914, 4,503,137, 4,559,290, JP-A-58-149046, JP-A-60-133449, JP-A-59-218443, JP-A-61-238056 (the term "JP-A" as used herein means an "unexamined published Japanese patent application"), EP 220746 A2, Kokai Giho No. 87-6199 and EP 210660 A2, etc.

Various methods have been proposed as to methods of obtaining positive color images by heat development. For example, a method in which a so-called dye releasing redox compound (hereinafter referred to as a DRR compound) is converted to a compound of an oxidized form having no dye-releasing capability, and the compound, in the presence of a reducing agent or a precursor thereof, is heat developed, the reducing agent is oxidized corresponding to the exposure amount of silver halide by heat development, and the compound is reduced by the remaining reducing agent not oxidized to release diffusible dyes is disclosed in U.S. Pat. No. 4,559,290. Further, a heat developable color photographic material using, as a compound which releases diffusible dyes by the same mechanism, a compound which releases diffusible dyes by the reductive cleavage of N—X bond (wherein X represents an oxygen atom, a nitrogen atom or a sulfur atom) is disclosed in EP 220746 A and Kokai Giho No. 87-6199 (No. 22, Vol. 12).

Conventionally used color photographic materials generally have blue, green and red spectral sensitization. For forming images on such color photographic materials using image information once converted to electric signals, a color CRT (cathode ray tube) is generally used as an exposure light source but CRT is inappropriate for obtaining a large size print.

A light emitting diode (LED) and a semiconductor laser (LD) have been developed as a write head capable of obtaining a large size print, but a photo-write head which efficiently emits blue light has not been developed yet.

Accordingly, for example, when LED is used, it is necessary to use a light source combining three LED's of near infrared (800 nm), red (670 nm) and yellow (570 nm) for exposing color photographic materials having three layers spectrally sensitized to infrared, red and yellow. A system of image recording according to such configuration is described in "Nikkei New Materials", pp. 47 to 57, Sep. 14, 1987, and has partly been put to practical use.

Further, a system of recording on a color photographic material having three light-sensitive layers each having spectral sensitization in wavelength of 880 nm, 820 nm and 760 nm using a light source combining three LD's showing emission of each of these wavelengths is disclosed in JP-A-61-137149.

In general, when yellow, magenta and cyan colors in a multilayer color photographic material are colored by exposure to light in three different spectral regions, it is an important technique in color reproduction to develop each color without color mixing. In particular, when LED or LD is used as an exposure light source, it is unavoidable to design three spectral sensitivities in a spectral region of narrow range (from red to infrared region), therefore, how to lessen the overlap of each spectral sensitivity is the key to the improvement of color isolation.

For ensuring color isolation, as is disclosed in U.S. Pat. No. 4,619,892, techniques of making the sensitivity in short wavelength side successively high or using a filter are known. However, if the sensitivity in short wavelength side is made successively high, fog increases and raw stock storability deteriorates with the lapse of time. In infrared sensitization, it has been difficult to achieve high sensitivity due to desensitization by the addition of dyes and the low efficiency of color sensitization.

For solving these problems, color photographic materials excellent in color isolation, showing high sensitivity and good raw stock storability due to the use of an infrared sensitizing dye of a J-band type of high spectral sensitivity are disclosed in JP-A-4-146431 and JP-A-5-45828.

The above heat developable color photographic materials are used in combination with an image-receiving material which mordants a diffusible dye. When an image obtained in this image-forming system is used as a color-proof in the printing field, the color reproduction level of the image obtained by synthesizing dye images of three colors of yellow, magenta and cyan is an important factor. That is, it is necessary that the image obtained in such an image-forming system should be able to cover the color reproduction level equal to or higher than the level of images obtained using standard printing ink. Further, the tint of a white ground part is required to coincide with the whiteness of standard paper for printing.

SUMMARY OF THE INVENTION

An object of the present invention is to form an image which is less in color difference from the image obtained using standard printing ink and also to form an image having a good white ground as a color-proof for printing, with an image-forming system comprising superposing a heat developable color photographic material onto an image-receiving material provided on a support separate from the support of the heat-developable color photographic material, and forming an image by transferring a diffusible dye.

Another object of the present invention is to provide a heat-developable color photographic material suitably used in the above image formation.

A further other object of the present invention is to provide an image-forming process which forms an image giving the texture nearer to the printed matter.

A still other object of the present invention is to provide an image-forming system which forms an image giving the texture nearer to the printed matter.

Other objects and effects of the present invention will become apparent from the following description.

The above objects of the present invention have been achieved by the following constitution:

1) A heat developable color photographic material for use in an image-forming process comprising:
   (a) superposing a heat developable color photographic material onto an image-receiving material that is formed on a separate support from a support of the heat developable color photographic material; and
   (b) heat-developing the heat developable color photographic material superposed on the image-receiving material to form or release a diffusible dye, so that the diffusible dye is transferred to the image-receiving material to thereby form an image, wherein the heat developable color photographic material contains at least a light-sensitive silver halide and yellow, magenta and cyan dye-donating compounds which form or release diffusible yellow, magenta and cyan dyes, respectively, by heat development corresponding to silver development, wherein the yellow dye has a maximum absorption intensity of spectral absorption at a wavelength of from 440 nm to 460 nm, the magenta dye has a maximum absorption intensity of spectral absorption at a wavelength of from 525 nm to 545 nm, and the cyan dye has a maximum absorption intensity of spectral absorption at a wavelength of from 610 nm to 640 nm, and wherein the heat developable color photographic material further contains at least one compound represented by the following formula (I) other than the above dye-donating compounds:

$$\mathrm{PWR}-(\mathrm{Time})_t-\mathrm{Dye} \qquad \text{(I)}$$

wherein PWR represents a group which releases $-(\mathrm{Time})_t\mathrm{Dye}$ upon reduction; Time represents a group which releases Dye via a subsequent reaction after being released as $-(\mathrm{Time})_t\mathrm{Dye}$; t represents an integer of 0 or 1; and Dye represents a dye or a precursor thereof.

2) An image-forming process comprising:
   (a) superposing a heat developable color photographic material onto an image-receiving material that is formed on a separate support from a support of the heat developable color photographic material; and
   (b) heat-developing the heat developable color photographic material superposed on the image-receiving material to form or release a diffusible dye, so that the diffusible dye is transferred to the image-receiving material to form an image, wherein the image-receiving material has a gloss of not higher than 20 after being processed, and wherein the heat developable color photographic material is one according to the above 1).

3) An image-forming system comprising:

a heat developable color photographic material;

an image-receiving material that is formed on a separate support from a support of the heat developable color photographic material, and on which the heat developable color photographic material is to be superposed;

means for heat-developing the heat developable color photographic material superposed on the image-receiving material to form or release a diffusible dye, so that the diffusible dye is transferred to the image-receiving material to thereby form an image, wherein the heat developable color photographic material is one according to the above 1).

DETAILED DESCRIPTION OF THE INVENTION

Figure 1:
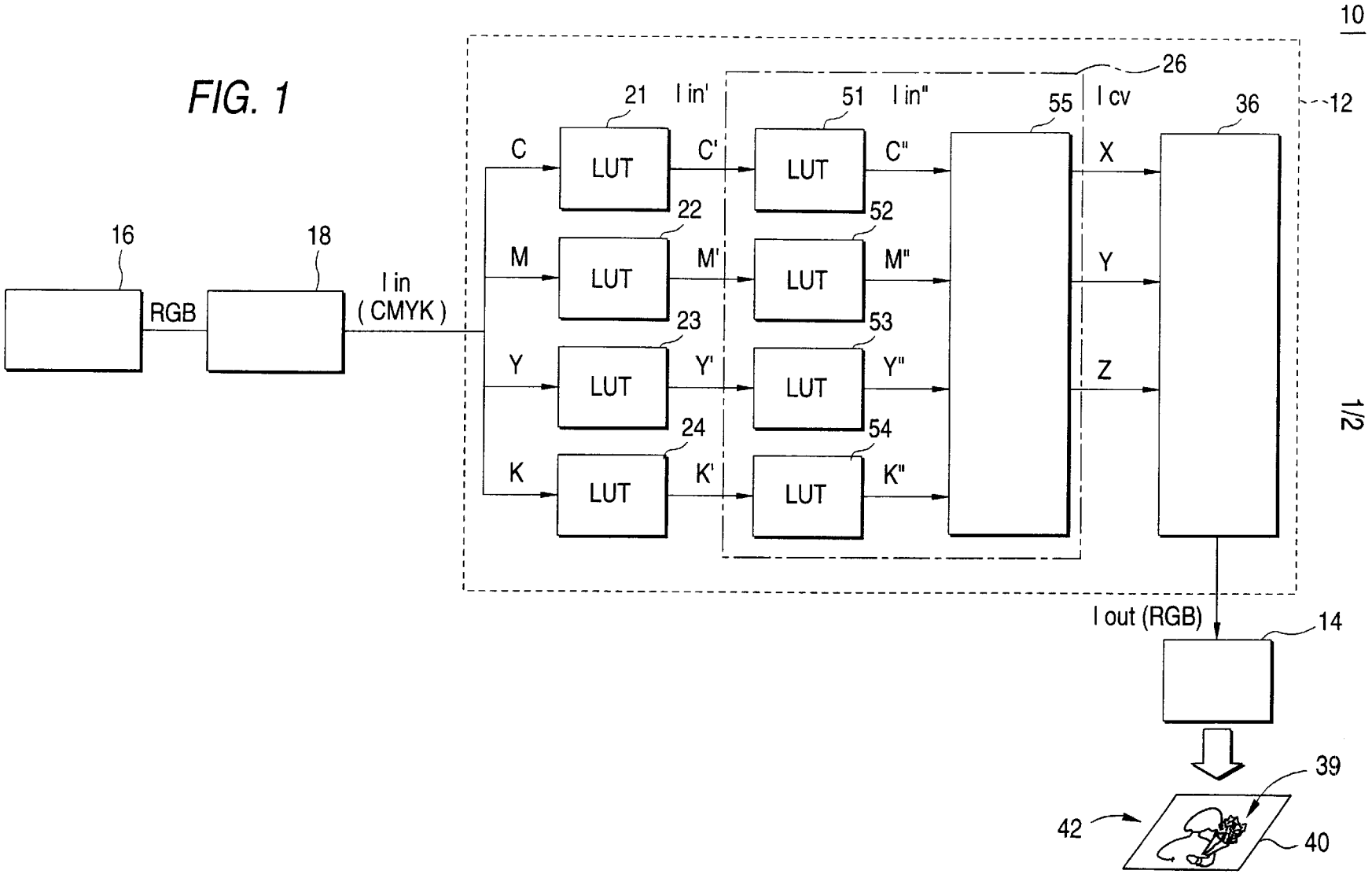
FIG. 1 is a block diagram showing the printing proof system for producing a proof for printing using a heat developable color photographic material according to the present invention.

Absorption wavelength of each dye released from or formed by a yellow, magenta and cyan dye-donating compound contained in the heat developable color photographic material for use in the present invention is prescribed. This is because peak wavelengths of three colors of yellow, magenta and cyan dyes and the absorption at the foot in the short wavelength side of the cyan dye are important for forming a color-proof for printing which coincides with the tint of the printed matter. In particular, the absorption of the cyan dye influences the color reproduction of pure cyan color and green. The terminologies "absorption", "hue" and "spectral absorption" of yellow, magenta and cyan dyes as used herein mean those of the spectral absorption in the state of each dye fixed in an image-receiving material.

As the dye-donating compound of each color, two or more dye-donating compounds can be used in admixture in the present invention to obtain desired hue. When dye-donating compounds are used in admixture, it is sufficient that the absorption peak of the dyes after being mixed falls within the range of the present invention and the absorption peak of the respective dye is not particularly restricted.

The heat developable color photographic material according to the present invention contains a compound which forms or releases cyan, magenta and yellow dyes corresponding to the reaction of reducing a silver ion to silver under high temperature, i.e., a dye-donating compound.

As the example of a dye-donating compound for use in the heat developable color photographic material according to the present invention, a compound which forms a dye upon oxidation coupling reaction (a coupler) can be exemplified in the first place. This coupler may be either 4-equivalent or 2-equivalent. 2-Equivalent couplers which have a diffusion-resisting group as a separable group and form a diffusible dye upon oxidation coupling reaction are also preferably used in the present invention. This diffusion-resisting group may be a polymer chain. Specific examples of color developers and couplers are described in detail in T. H. James, "The Theory of the Photographic Process", 4th Ed., pp. 291 to 334 and 354 to 361, "Research Disclosure", No. 307105, p. 871, JP-A-58-123533, JP-A-58-149046, JP-A-58-149047, JP-A-59-111148, JP-A-59-124399, JP-A-59-174835, JP-A-59-231539, JP-A- 59-231540, JP-A-60-2950, JP-A-60-2951, JP-A-60-14242, JP-A-60-23474 and JP-A-60-66249.

Further, as the example of the dye-donating compound different from the above-described couplers, compounds having the function of imagewise releasing or diffusing a diffusible dye can be exemplified. Compounds of this type can be represented by the following formula (L1):

$$((\text{Dye})_m\text{—Y})_n\text{—Z} \quad \text{(L1)}$$

wherein Dye represents a dye group, or a dye group or precursor thereof which is shifted to shortwave temporarily; Y represents a single bond or a linking group; Z represents a group having the function of imagewise making difference in diffusibility of the compound represented by $((\text{Dye})_m\text{—Y})_n\text{—Z}$ corresponding to light-sensitive silver salt having a latent image, or releasing $(\text{Dye})_m\text{—Y}$ and differentiating the released $(\text{Dye})_m\text{—Y}$ from $((\text{Dye})_m\text{—Y})_n\text{—Z}$ in diffusibility; m represents an integer of from 1 to 5; and n represents an integer of 1 or 2, and when m or n does not represents 1, a plurality of Dyes may be the same or different.

Specific examples of the dye-donating compounds represented by formula (L1) include the compounds belonging to the following (1) or (2).

(1) Couplers which have a diffusible dye as a separable group and release the diffusible dye upon reaction with the oxidized product of a reducing agent (a DRR coupler). Specific examples are disclosed in British Patent 1,330,524, JP-B-48-39165 (the term "JP-B" as used herein means an "examined Japanese patent publication"), U.S. Pat. Nos. 3,443,940, 4,474,867, and 4,483,914.

(2) Compounds which are reducible against silver halide or organic silver salt and release a diffusible dye when the object (a DRR compound) have been reduced. This compound is particularly preferred as it is not necessary to use other reducing agent, which causes no problem of contamination of the image due to oxidation decomposed product of a reducing agent. Representative examples are disclosed in U.S. Pat. Nos. 3,928,312, 4,053,312, 4,055,428, 4,336,322, JP-A-59-65839, JP-A-59-69839, JP-A-53-3819, JP-A-51-104343, RD No. 17465, U.S. Pat. Nos. 3,725,062, 3,728,113, 3,443,939, JP-A-58-116537, JP-A-57-179840, and U.S. Pat. No. 4,500,626. Specific examples of DRR compounds are those disclosed in U.S. Pat. No. 4,500,626, columns from 22 to 44, and Compounds (1) to (3), (10) to (13), (16) to (19), (28) to (30), (33) to (35), (38) to (40), (42) to (64) disclosed in U.S. Pat. No. 4,500,626 are preferred above all. Further, compounds disclosed in U.S. Pat. No. 4,639,408, columns from 37 to 39 are also useful. In addition to the above-described couplers and the dye-donating compound represented by formula (L1), the dye silver compound combining organic silver salt and a dye (e.g., described in "Research Disclosure", April, 1978, pp. 30 to 32) and leuco dyes (e.g., U.S. Pat. Nos. 3,985,565 and 4,022,617) can also be used as a dye-donating compound.

Of the above-described compounds, DRR compounds are preferably used in the present invention.

Specific examples of DRR compounds which can be used in the heat developable color photographic material according to the present invention are shown below, but it should not be construed as limiting the present invention. These DRR compounds can be used alone or in combination of two or more thereof, but the cyan dye-donating compounds are preferably used in combination of two or more thereof.

First, specific examples of cyan DRR compounds are shown below. With respect to cyan, the case where the dye released from the dye-donating compound(s) is a mixture comprising one or more dyes having λmax of from 600 nm to 650 nm and one or more dyes having λmax of from 650 nm to 700 nm is particularly preferred.

(1) Specific examples of DRR compounds having a cyan dye having λmax of from 600 nm to 650 nm in the molecule are shown below.

Cyan Dye-Donating Compound

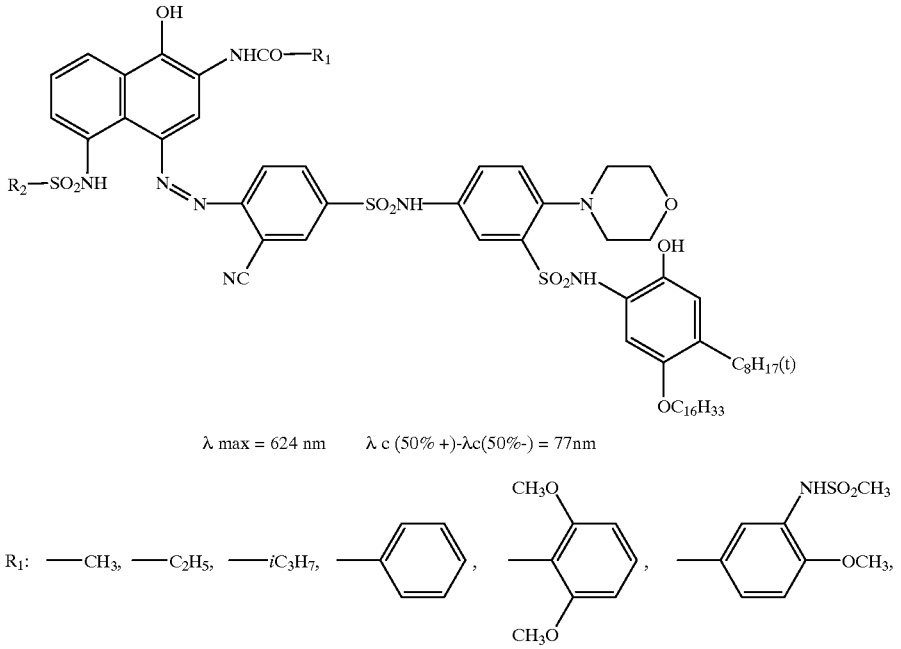

-continued
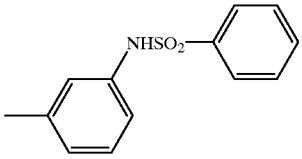
$R_2$:
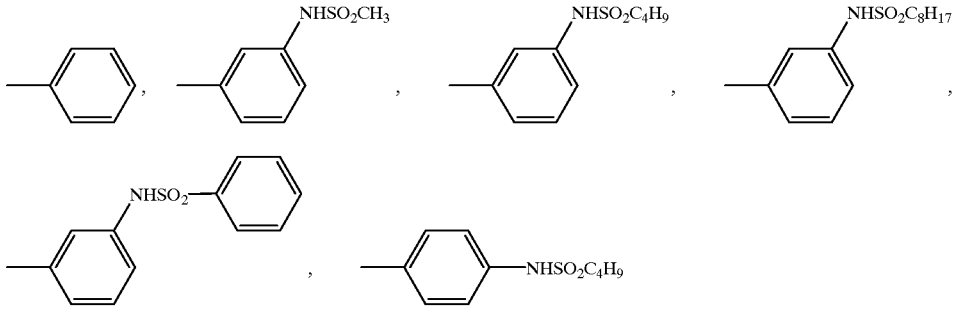
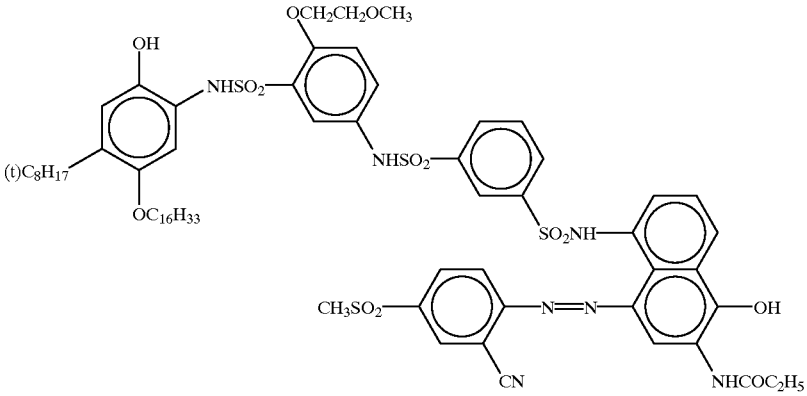
λ max = 623 nm
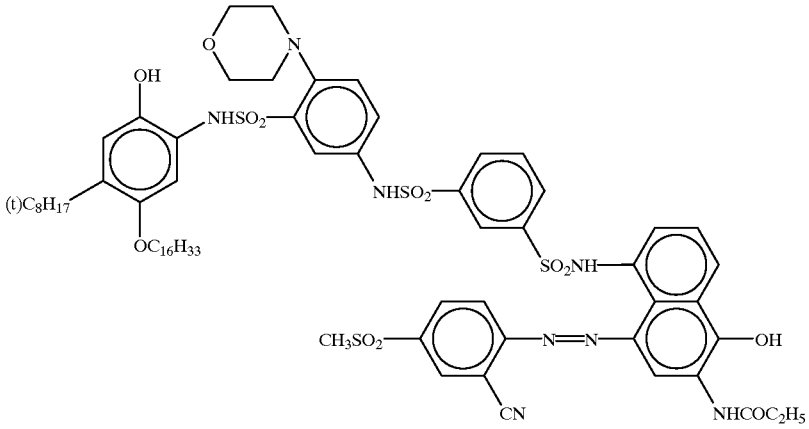
λ max = 623 nm
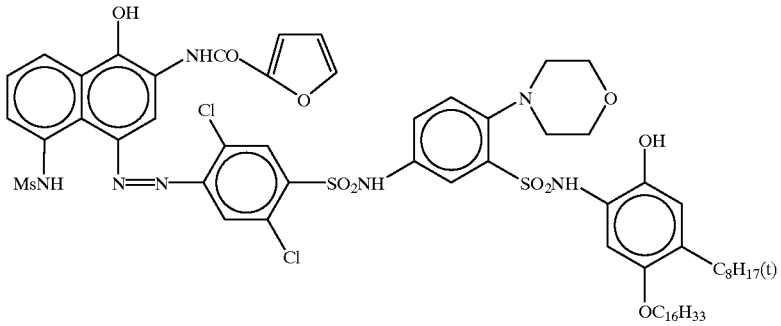
λ max = 632 nm -continued
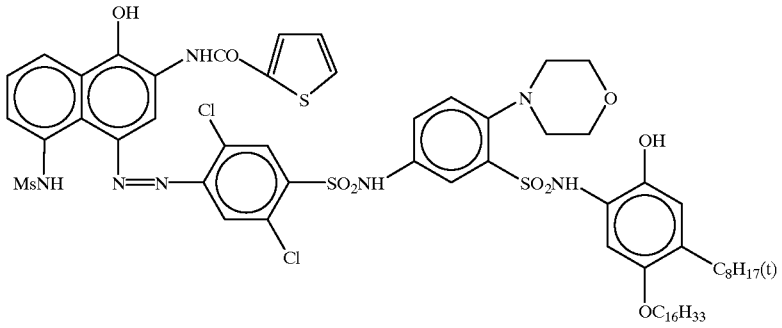
λ max = 632 nm
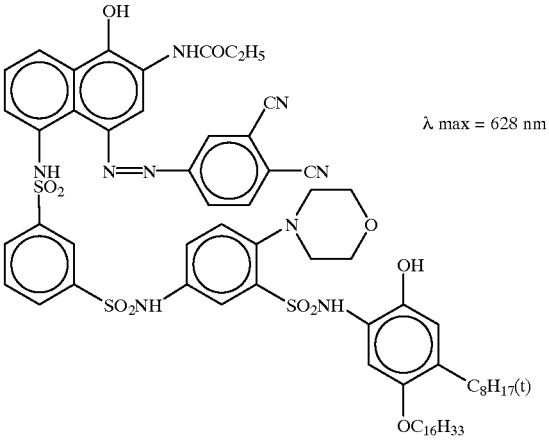
λ max = 628 nm
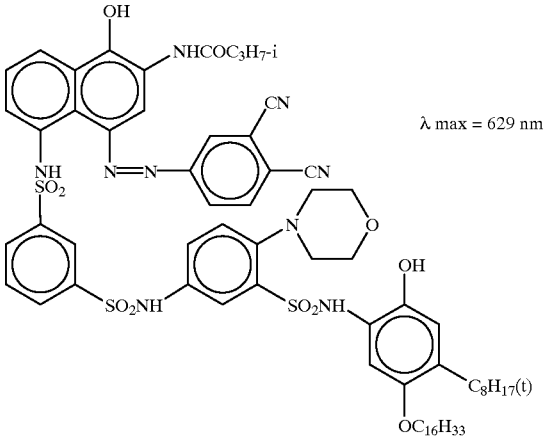
λ max = 629 nm
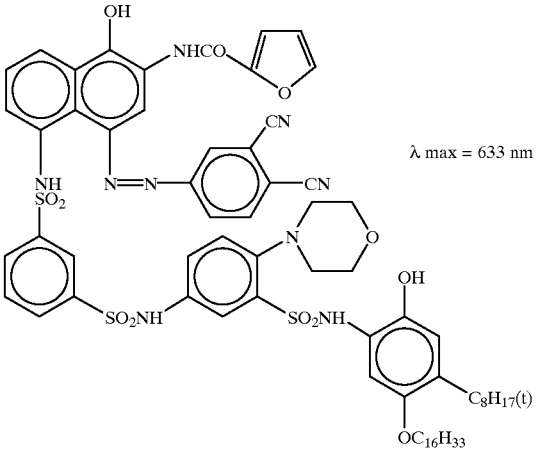
λ max = 633 nm
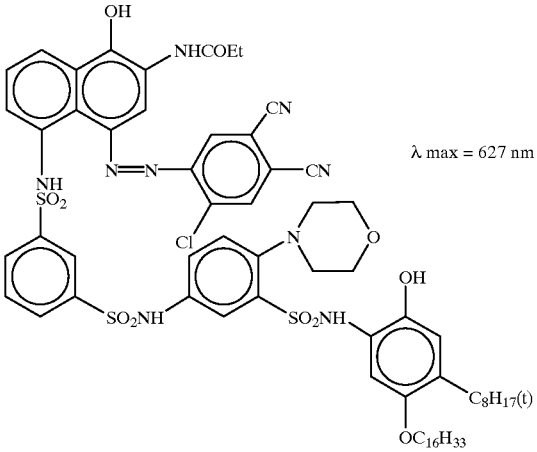
λ max = 627 nm -continued
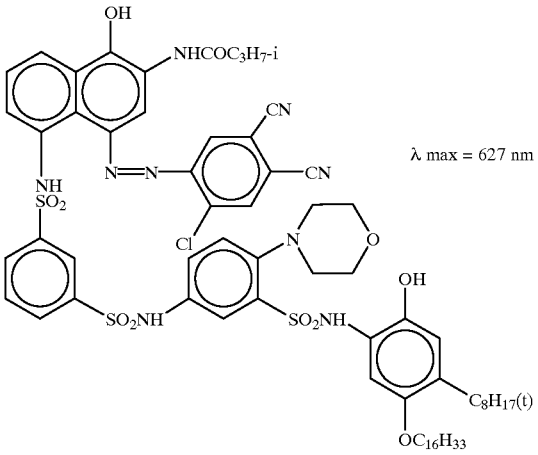
λ max = 627 nm
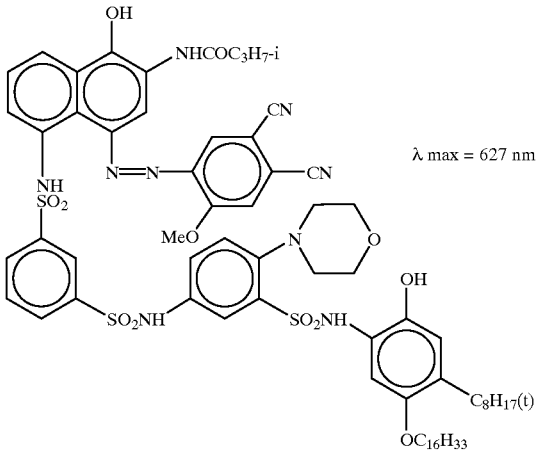
λ max = 627 nm
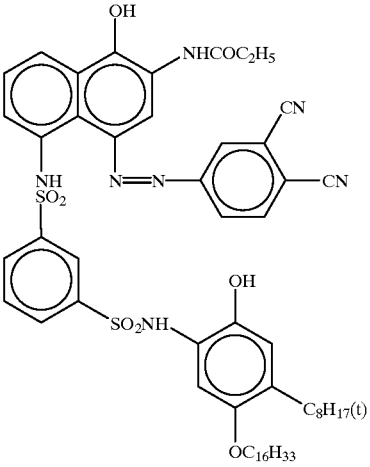
λ max = 632 nm
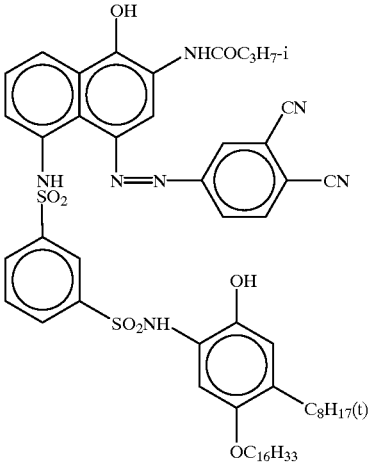
λ max = 628 nm
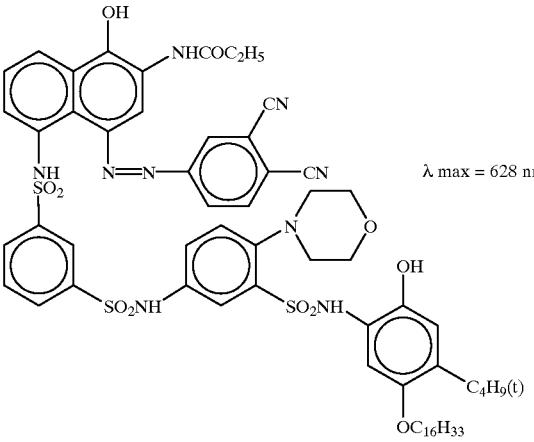
λ max = 628 nm
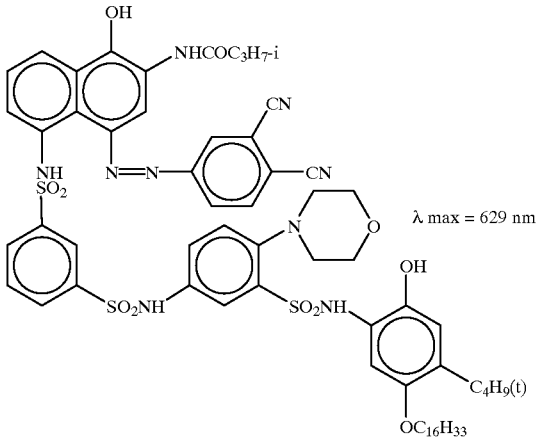
λ max = 629 nm (2) Specific examples of DRR compounds having a cyan dye having λmax of from 650 nm to 700 nm in the molecule are shown below.
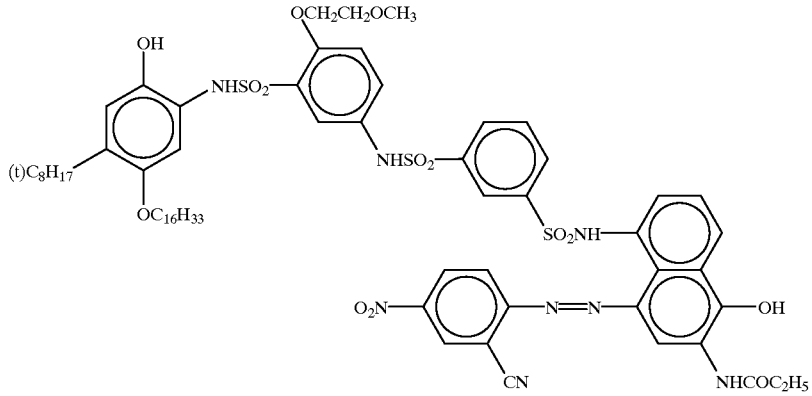
λ max = 660 nm
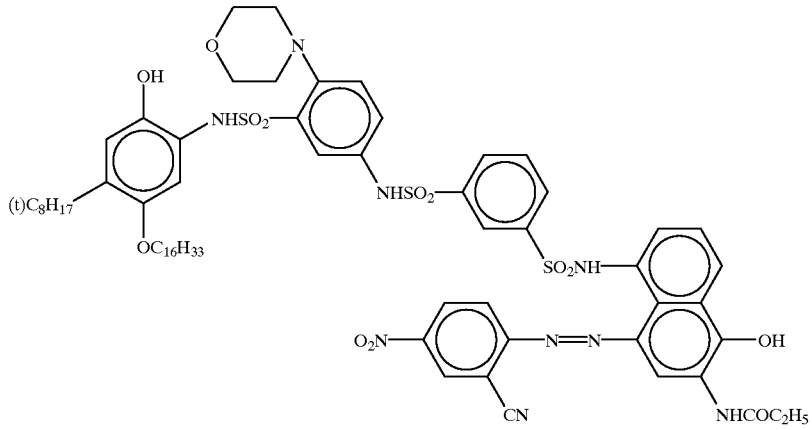
λ max = 660 nm
Specific examples of magenta DRR compounds are shown below.
Magenta Dye-Donating Compounds
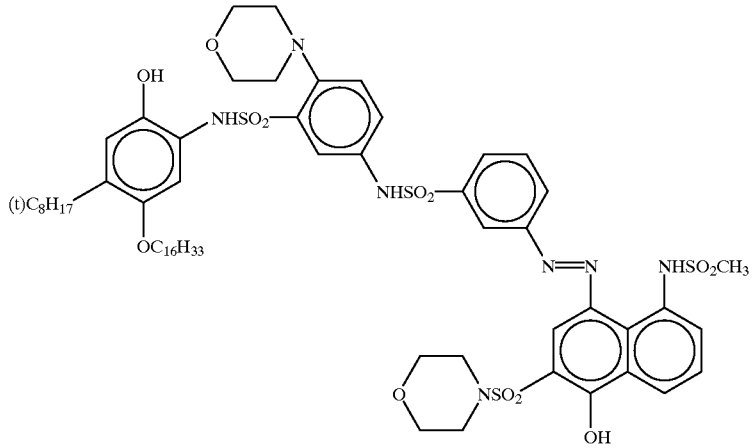

-continued
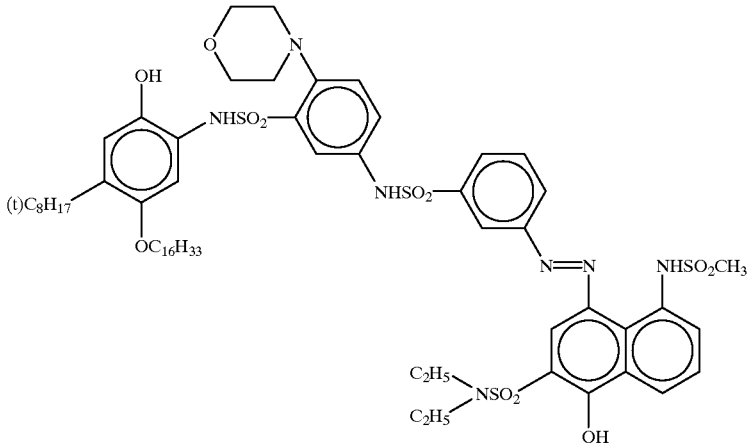
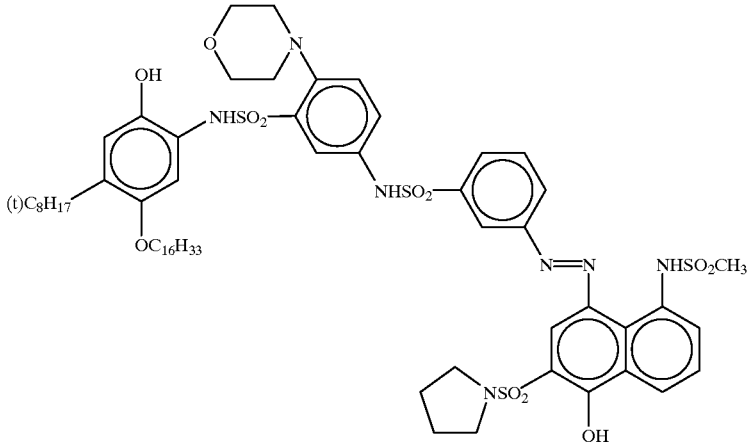
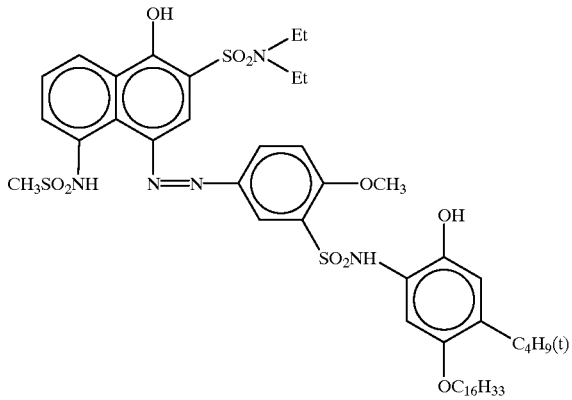

-continued
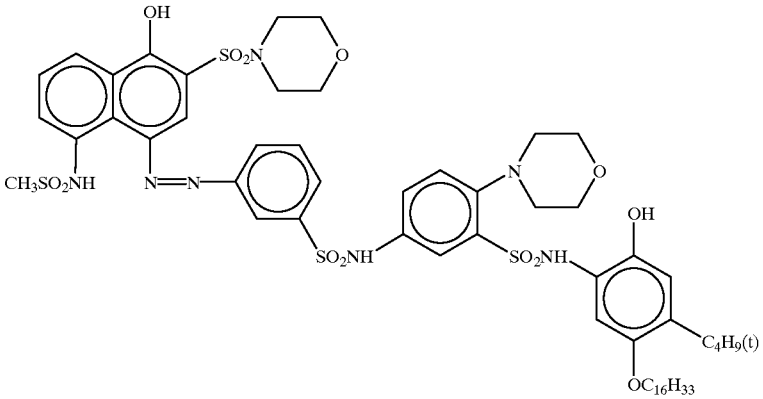
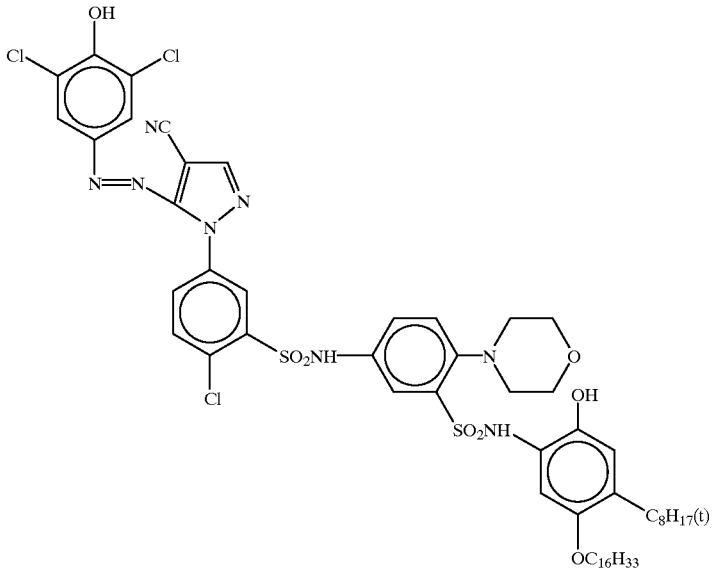
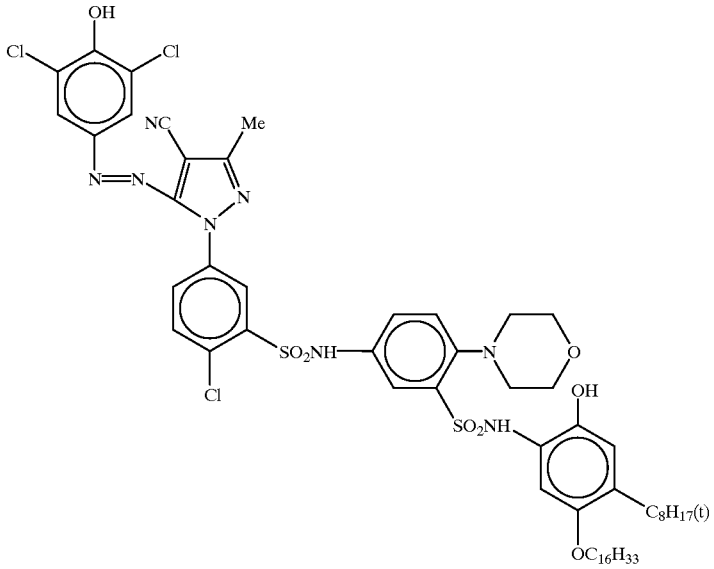

-continued
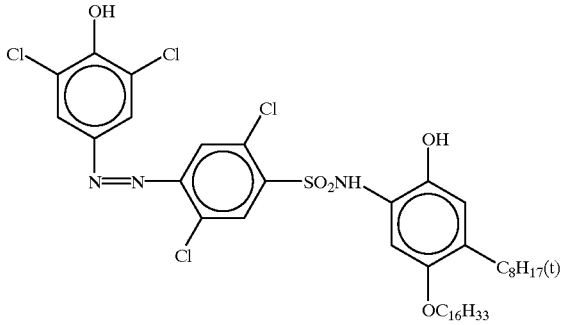
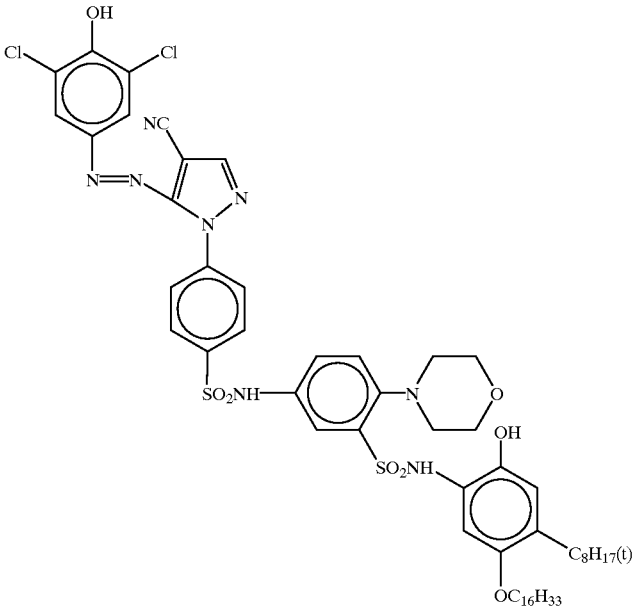
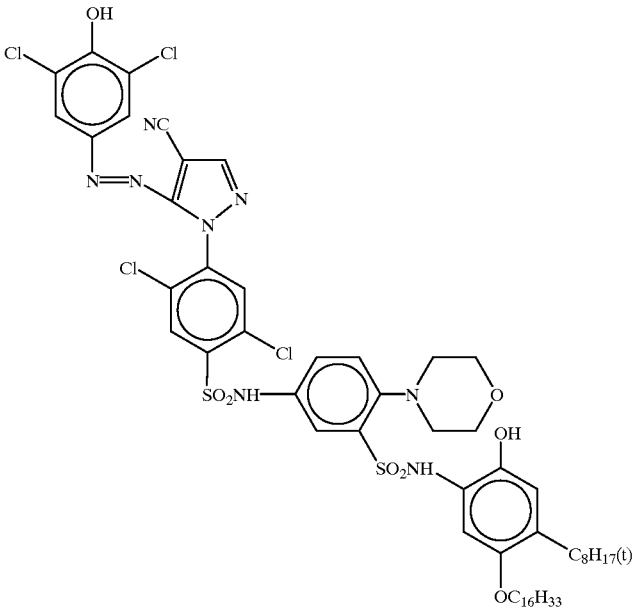

-continued
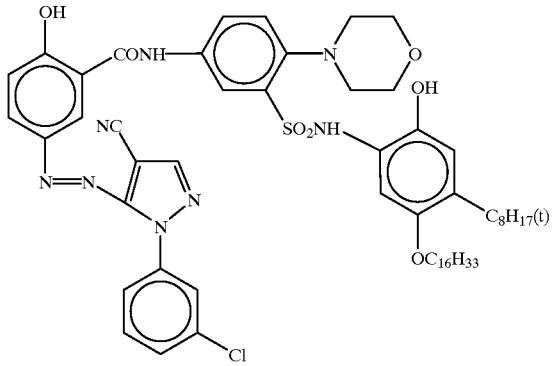
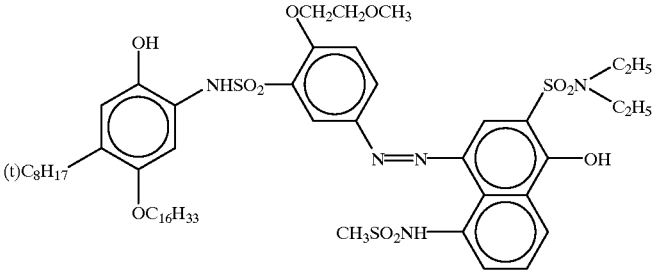
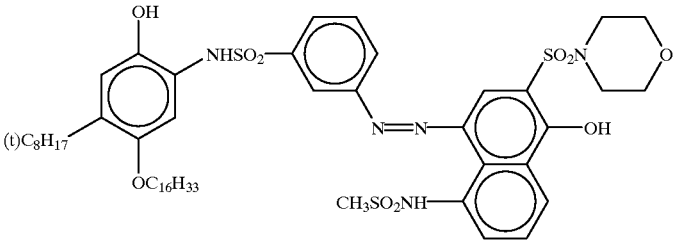
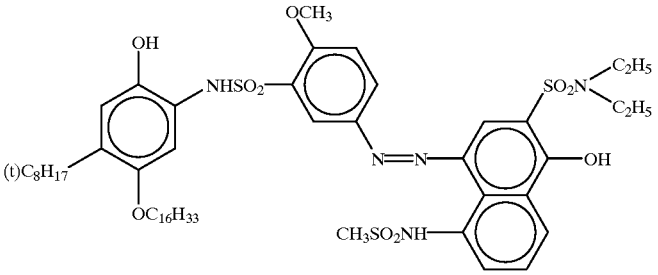
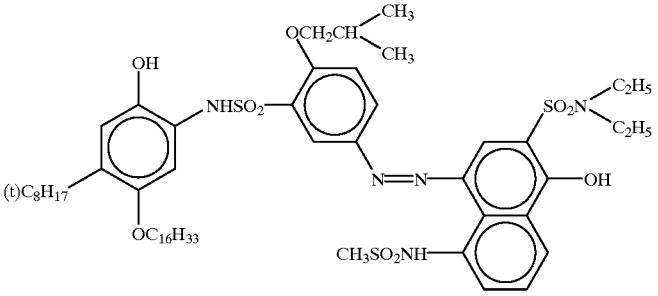

Specific examples of yellow DRR compounds are shown below.

Yellow Dye-Donating Compounds

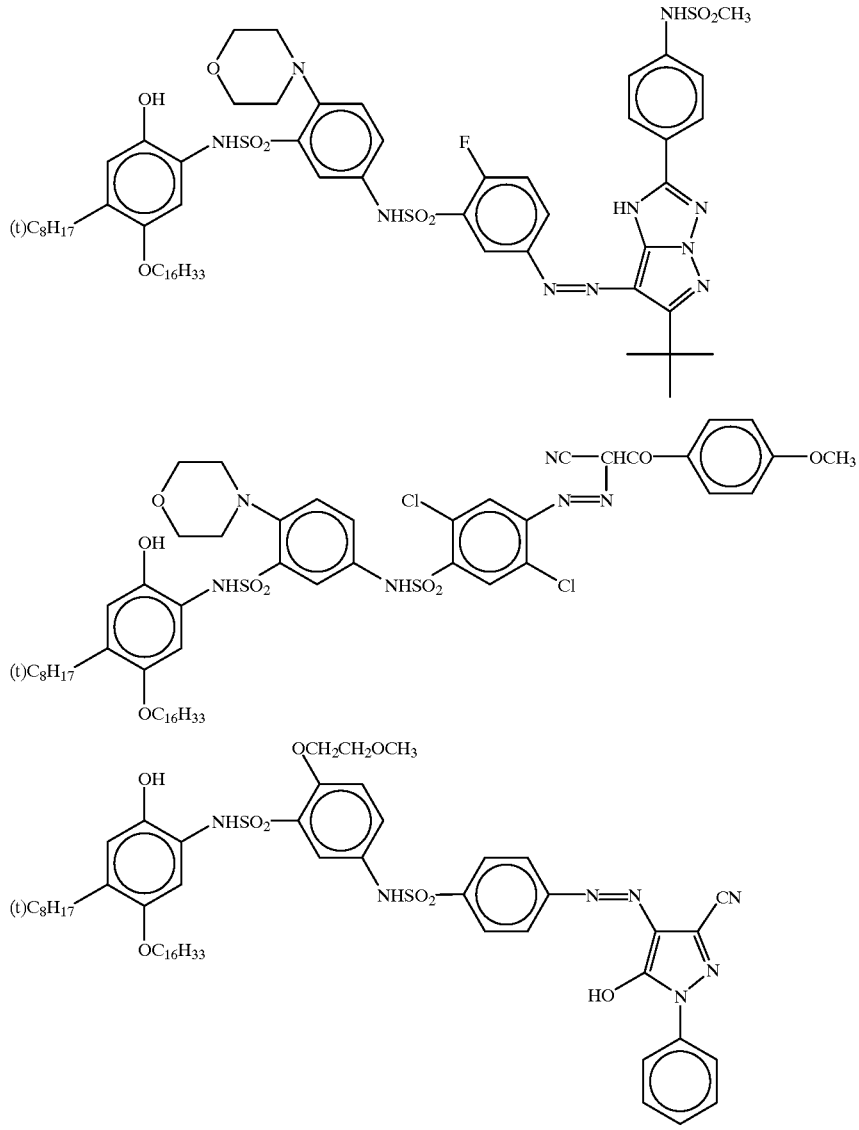

For each color dye-donating compound, the addition amount of these dye-donating compounds is generally from 0.01 to 2.0 g/m$^2$, preferably from 0.05 to 1.0 g/m$^2$.

Formula (I) is described in detail below.

First, PWR is described in detail.

PWR may be a group corresponding to a part which contains an electron acceptability center in a compound which releases a photographic reagent by an intramolecular nucleophilic substitution reaction after being reduced and the intramolecular nucleophilic substitution reaction center as disclosed in U.S. Pat. Nos. 4,139,389, 4,139,379, 4,564,577, JP-A-59-185333 and JP-A-57-84453. Alternatively, PWR may be a group corresponding to a part which contains an electron acceptable quinonoid center in a compound which releases a photographic reagent by an intramolecular electron transfer reaction after being reduced and a carbon atom connecting the quinonoid center with the photographic reagent as disclosed in U.S. Pat. No. 4,232,107, JP-A-59-101649, "Research Disclosure", No. 24025, 1V (1984) and JP-A-61-88257. Further, PWR may be a group corresponding to a part which contains an aryl group substituted with an electron attractive group in a compound which releases a photographic reagent by a single bond cleavage after being reduced and an atom (a sulfur atom, a carbon atom or a nitrogen atom) connecting the electron attractive group-substituted aryl group with the photographic reagent as disclosed in JP-A-56- 142530, U.S. Pat. Nos. 4,343,893 and 4,619,884. Still further, PWR may be a group corresponding to a part which contains a nitro group in a nitro compound which releases a photographic reagent after accepting an electron and a carbon atom connecting the nitro group with the photographic reagent as disclosed in U.S. Pat. No. 4,450,223, or may be a group corresponding to a part which contains a dieminaldinitro part in a dinitro compound which beta-desorbs a photographic reagent after electron acceptance and a carbon atom connecting the dieminaldinitro part with the photographic reagent as disclosed in U.S. Pat. No. 4,609,610.

Further, more preferably, PWR may be a compound having an N—X bond (X represents an oxygen atom, a sulfur atom or a nitrogen atom) and an electron attractive group in one molecule as disclosed in EP 220746 A2, Kokai Giho No. 87-6199, U.S. Pat. No. 4,783,396, JP-A-63-201653 and JP-A-63-201654; a compound having an $SO_2$—X bond (X has the same meaning as above) and an electron attractive group in one molecule as disclosed in JP-A-1-26842; a compound having a PO—X bond (X has the same meaning as above) and an electron attractive group in one molecule as disclosed in JP-A-63-271344; or a compound having a C—X' bond (X' has the same meaning as X or represents —$SO_2$—) and an electron attractive group in one molecule as disclosed in JP-A-63-271341. Further, a compound which releases a diffusible dye by single bond cleavage after reduction by a π-bond conjugating with an electron accepting group as disclosed in JP-A-1-161237 and JP-A-1-161335 can also be used.

For sufficiently achieving the object of the present invention, the compound represented by formula (I) is preferably represented by formula (II):

(II)

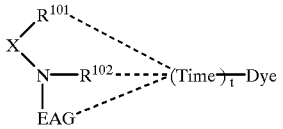

In formula (II),

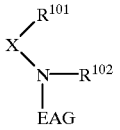

corresponds to PWR.

(Time)$_t$Dye is bonded to one of $R^{101}$, $R^{102}$ and EAG; X represents a group containing an oxygen atom (—O—), a sulfur atom (—S—), or a nitrogen-containing group (13 N($R^{103}$)—).

$R^{101}$, $R^{102}$ and $R^{103}$ each represents a group other than a hydrogen atom, or a single bond. As groups other than a hydrogen atom represented by $R^{101}$, $R^{102}$ and $R^{103}$, an alkyl group, an aralkyl group, an alkenyl group, an alkynyl group, an aryl group, a heterocyclic group, a sulfonyl group, a carbamoyl group, and a sulfamoyl group can be exemplified. These groups may have a substituent.

$R^{101}$ and $R^{103}$ each preferably represents a substituted or unsubstituted alkyl, alkenyl, alkynyl, aryl, heterocyclic, acyl or sulfonyl group. $R^{101}$ and $R^{103}$ preferably have from 1 to 40 carbon atoms.

$R^{102}$ preferably represents a substituted or unsubstituted acyl or sulfonyl group. Examples are the same as the acyl group and the sulfonyl group described in $R^{101}$ and $R^{103}$. $R^{102}$ preferably has from 1 to 40 carbon atoms. $R^{101}$, $R^{102}$ and $R^{103}$ may be bonded to each other to form a 5- to 8-membered ring.

X preferably represents an oxygen atom.

EAG represents a group accepting an electron from a reduced substance and is bonded to a nitrogen atom. EAG is preferably a group represented by the following formula (A):

(A)

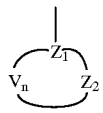

In formula (A), $Z_1$ represents

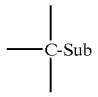

or

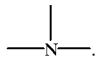

$V_n$ represents an atomic group to form a 3- to 8-membered aromatic ring together with $Z_1$ and $Z_2$, and n represents an integer of from 3 to 8.

$V_3$ means —$Z_3$—, $V_4$ means —$Z_3$—$Z_4$—, $V_5$ means —$Z_3$—$Z_4$—$Z_5$—, $V_6$ means —$Z_3$—$Z_4$—$Z_5$—$Z_6$—, $V_7$ means —$Z_3$—$Z_4$—$Z_5$—$Z_6$—$Z_7$—, and $V_8$ means —$Z_3$—$Z_4$—$Z_5$—$Z_6$—$Z_7$—$Z_8$—.

$Z_2$ to $Z_8$ each represents

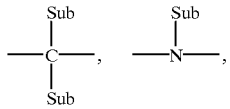

—O—, —S— or —$SO_2$—; and Sub represents a single bond (a π-bond), a hydrogen atom, or a substituent described below, a plurality of Sub's may be the same or different, or they may be bonded to each other to form a 3- to 8-membered saturated or unsaturated carbon ring or a heterocyclic ring.

In formula (A), Sub is selected so that the sum of the Hammett's substituent constant $\sigma_p$ values becomes +0.5 or more, more preferably +0.7 or more, and most preferably +0.85 or more.

EAG preferably represents an aryl group substituted with at least one electron attractive group, or a heterocyclic group. A substituent bonded to the aryl group or the heterocyclic group represented by EAG can be utilized for controlling the whole physical properties of the compound. Examples of controlling of physical properties of the compound at large include, besides controlling of easiness of acceptance of an electron, e.g., controlling of water solubility, oil solubility, diffusibility, sublimation property, melting point, dispersibility in a binder such as gelatin, reactivity to a nucleophilic group, and reactivity to an electrophilic group.

Specific examples of EAG are disclosed in EP 220746 A2, pp. 6 and 7.

The compound represented by formula (II) has a function of releasing (Time)$_t$Dye triggered by the cleavage of N—X bond by the acceptance (reduction) of an electron by EAG.

Time represents a group which releases a dye via a subsequent reaction triggered by the cleavage of nitrogen-oxygen, nitrogen—nitrogen, or nitrogen-sulfur bond.

Groups represented by Time are well-known, e.g., groups described in JP-A-61-147244, pp. 5 and 6, JP-A-61-236549, pp. 8 to 14, and JP-A-62-215270, pp. 36 to 44 can be exemplified.

Dyes represented by Dye include an azo dye, an azomethine dye, an anthraquinone dye, a naphthoquinone dye, a styryl dye, a nitro dye, a quinoline dye, a carbonyl dye, and a phthalocyanine dye. These dyes can be used in the form of shortwave temporarily shifted which can restore colors at development.

Specifically, Dyes disclosed in EP 76492 A and JP-A-59-165054 can be used.

The compound represented by formula (II) per se is necessary to be non-migratory in a photographic layer and it is preferred, for that purpose, to have a ballast group having 8 or more carbon atoms at the position of EAG, $R^{101}$, $R^{102}$, $R^{103}$ or X (in particular, at the position of EAG).

Representative examples of dye-donating compounds to be reduced for use in the present invention are shown below but the present invention is not limited thereto, and dye-donating compounds disclosed in EP 220746 A2 and Kokai Giho No. 87-6199 can also be used.

(1)

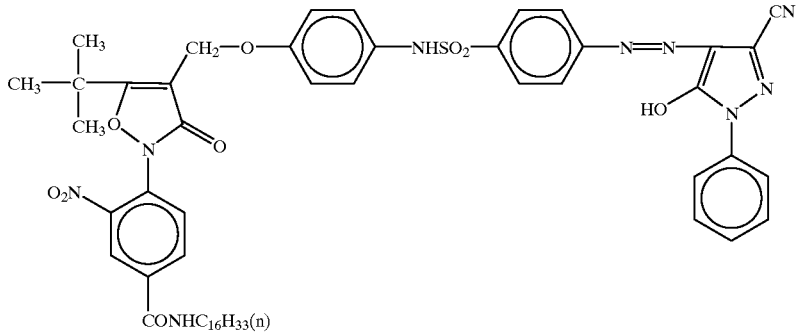

(2)

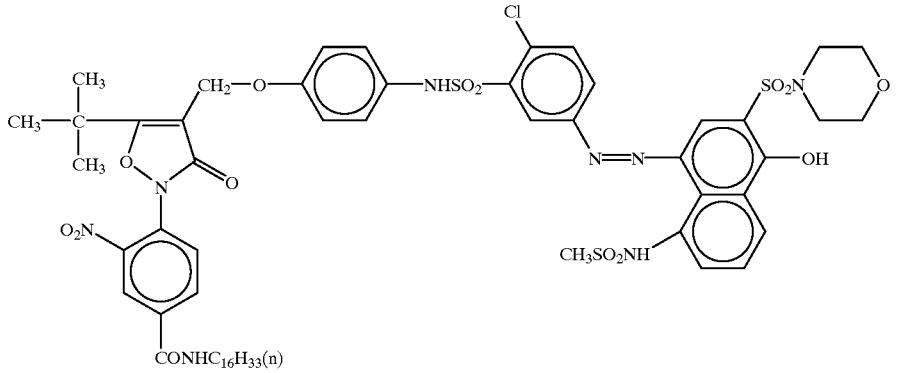

(3)

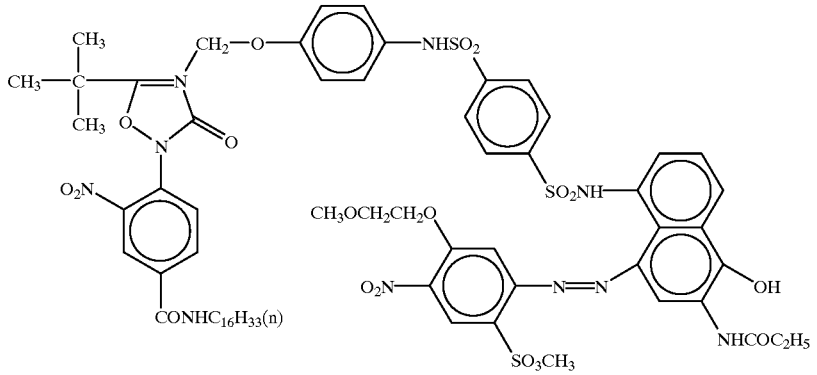

-continued
(4)
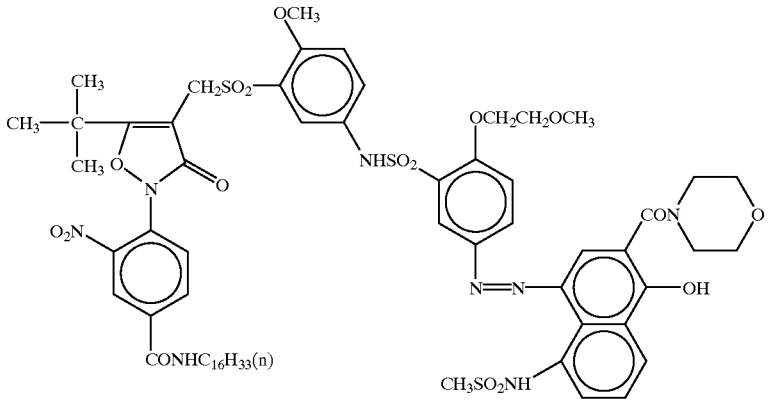
(5)
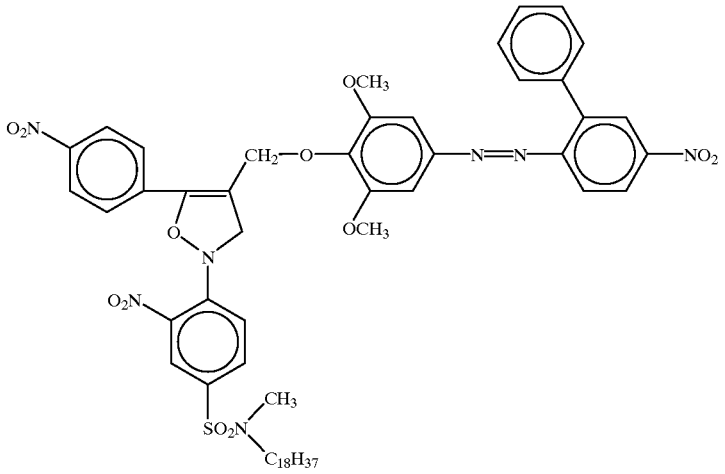
(6)
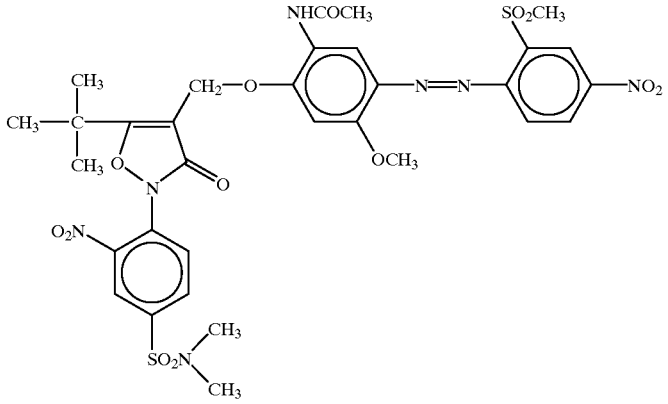

-continued
(7)
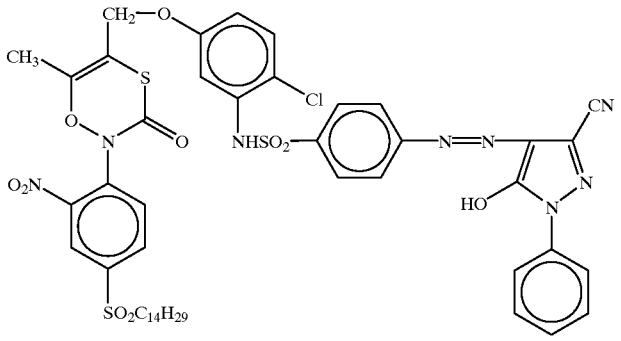
(8)
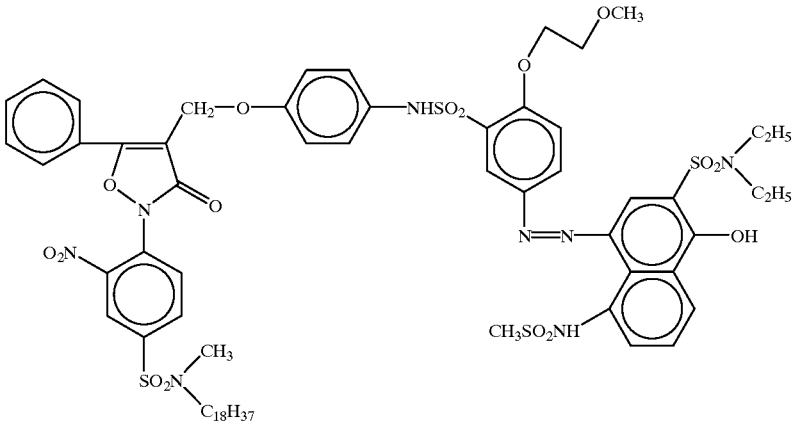
(9)
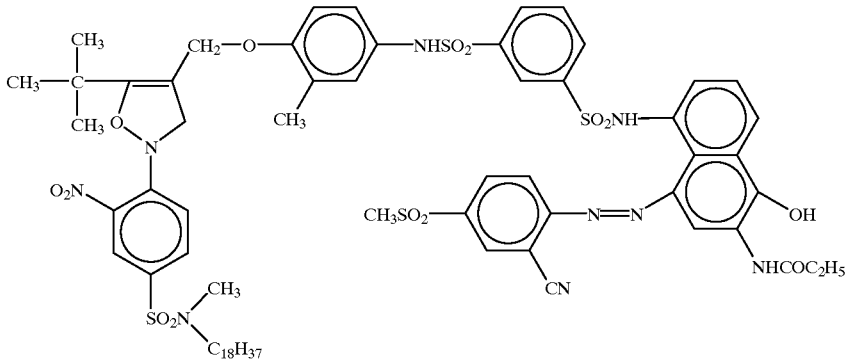
(10)
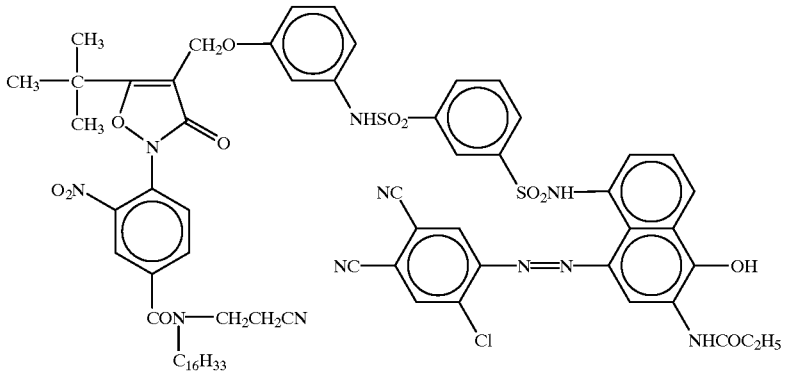

-continued
(11)
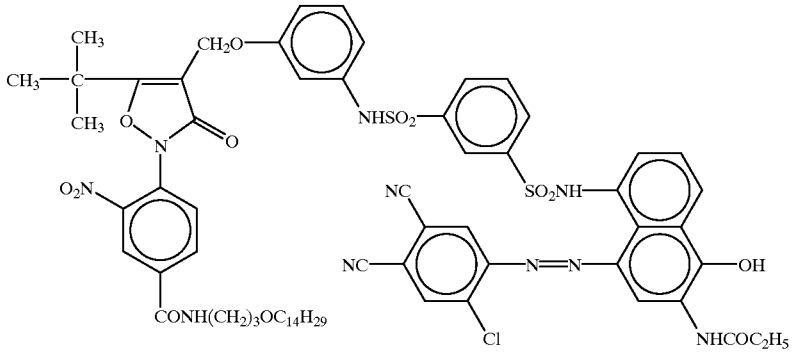
(12)
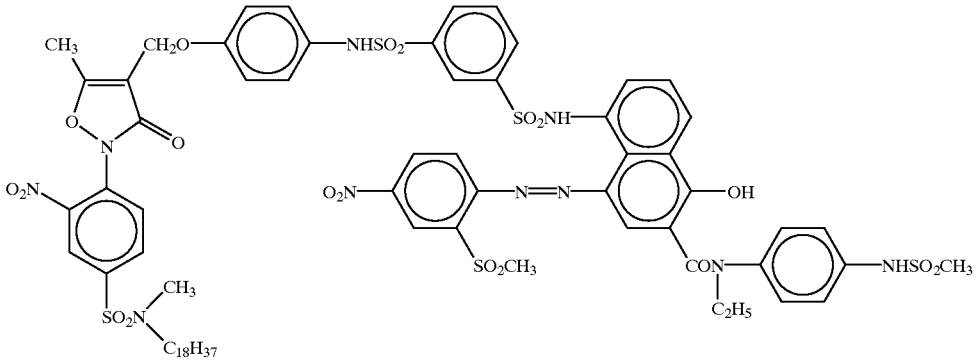
(13)
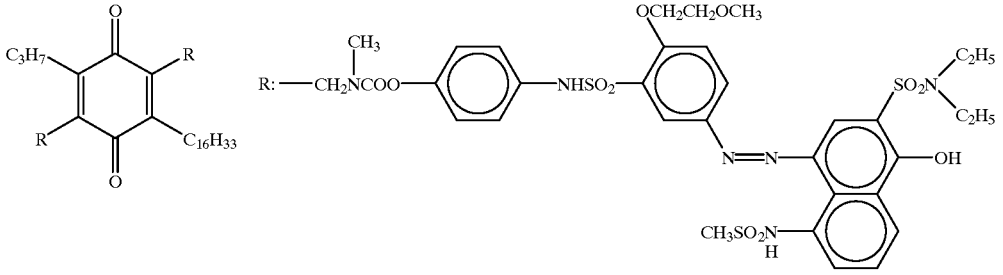
(14)
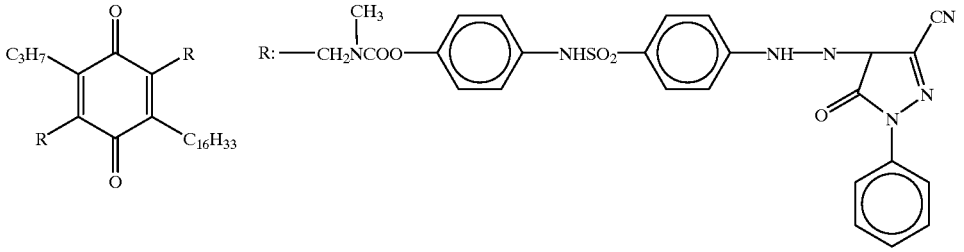

-continued (15)

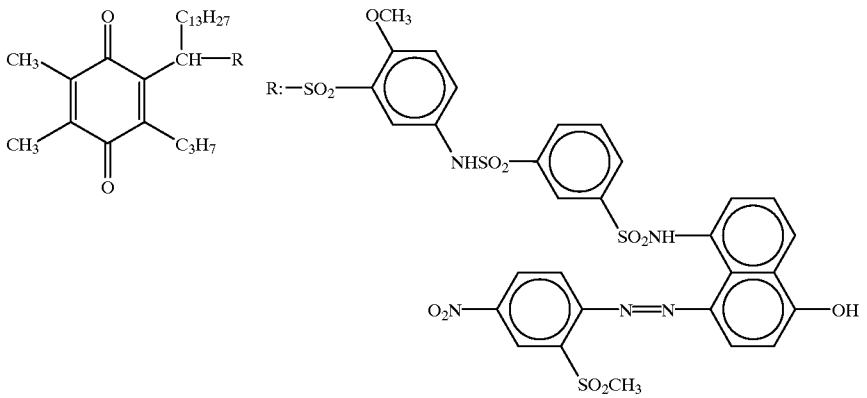

(16)

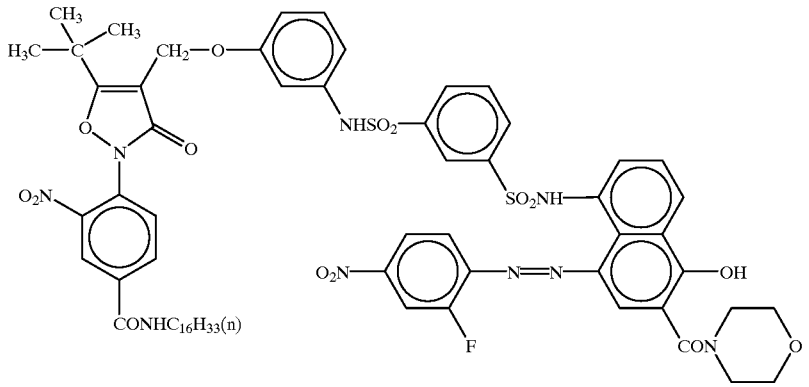

These compounds can be synthesized according to the methods disclosed in the patents cited above.

The amount to be used of the compound represented by formula (I) is from 0.05 to 5 mg/m$^2$, preferably from 0.1 to 3 mg/m$^2$, although it depends on the absorption coefficient of the Dye portion. The compound may be added to an emulsion layer or an interlayer. The compound represented by formula (I) can be used alone or in combination of two or more.

A white ground is described below.

As standard paper for printing, Tokuryo Art and NK Espel can be exemplified. For achieving the tint of the desired whiteness as a color-proof for printing, the whiteness of the present invention should coincide with the whiteness of these papers. The tint of the desired whiteness in the present invention means that the point (a, b) on the chromaticity diagram in CIE colorimetric system Lab values falls within the range of $-2 \leqq a \leqq 2$, $-1 \leqq b \leqq 4$, more preferably $-1 \leqq a \leqq 1$, $0 \leqq b \leqq 3$.

Due to the above relationship, the balance of whiteness can be freely controlled in the present invention. That is, when whiteness balance is lacking for magenta, the desired whiteness can be obtained by incorporating a necessary amount of a compound represented by formula (I) which releases a magenta dye. When yellow is short or cyan is short, the whiteness balance can be controlled in the same manner. By use of yellow, magenta and cyan in combination, the balance can be controlled in any direction on the chromaticity diagram.

The heat developable color photographic material for use in the present invention fundamentally comprises a support having thereon light-sensitive silver halide, a binder and a dye-donating compound (a reducing agent serves also as a dye-donating compound in some cases as described below). In addition to the above, an organic metal salt oxidizing agent may be contained, if necessary. These components are in many cases added to the same layer but they may be added dividedly to different layers if it is possible to cause reaction. For example, when a colored dye-donating compound is present in the lower silver halide emulsion layer, the reduction of sensitivity can be prevented. A reducing agent is preferably incorporated into the heat developable photographic material, but it may be supplied from the outside, e.g., by a method of diffusing from an image-receiving material, as is described later. However, color image formation is accelerated by the incorporation of a reducing agent into a photographic material.

Gloss as used in the present invention can be determined by various methods. A representative method is described in "Technical Association of the Pulp and Paper Industry", T442su-72.

Gloss in the present invention means the gloss when determined using a digital deformation glossimeter UGV-5D (a product of Suga Testing Machine Co., Ltd.), by the conditions of incident angle: 20°, light reception angle: 20°, a throttle plate for a light source part: aperture of 8 mm square, and others are by the prescribed conditions. Other glossimeters can be used for determination (e.g., a glossimeter manufactured by Gardner Co., U.S.A., a Hunter type calorimetric glossimeter, etc.).

The gloss of an image largely affects the texture of that image. That is, if the gloss is high, the image gives photographic texture. There are a variety of printing papers and glosses are different according to printing papers. When the gloss is low, the texture is near to the plain paper print. In the present invention, for obtaining the texture near to the plain paper print, gloss is 20 or less, preferably 15 or less.

The gloss of the image-receiving material according to the present invention can be controlled by selecting the kind and the addition amount of a matting agent contained in the image-receiving material and the layer to which a matting agent is added. Kinds of matting agents which can be used are described later.

As for the addition amount of a matting agent, the more the addition amount, the lower is the gloss. Larger effect can be obtained when a matting agent is added in an upper layer (the layer on the opposite side of the support).

Preferred addition amount for making the gloss 20 or less largely differs according to the selection of the kind of a matting agent and the layer to which a matting agent is added. For example, when the kinds of matting agents and addition layers described in Example of the present invention are selected, the total addition amount of the matting agent in the image-receiving layer is 50 $mg/m^2$ or more, preferably 80 $mg/m^2$ or more, more preferably 100 $mg/m^2$ or more, and the upper limit is 2.5 $g/m^2$.

For obtaining a wide range of colors on the chromaticity diagram using three primary colors of yellow, magenta and cyan, at least three silver halide emulsion layers each having light sensitivity in a different spectral region can be used in combination. For example, there are a combination of a blue-sensitive layer, a green-sensitive layer and an infrared-sensitive layer, a combination of a green-sensitive layer, a red-sensitive layer and an infrared-sensitive layer, and a combination of a red-sensitive layer, a first infrared-sensitive layer, and a second infrared-sensitive layer. These combinations are disclosed in JP-A-59-180550, JP-A-64-13546, JP-A-62-253159 and European Patent Publication 479167. Each light-sensitive layer can take various orders of arrangement known in general color photographic materials. Further, each layer may be divided into two or more layers, if necessary. These light-sensitive layers are disclosed in JP-A-1-252954. The kinds of dye-donating compounds (yellow, magenta and cyan) combined with each of these light-sensitive layers are arbitrary when a color image is reproduced from an electrically signalized image information as in the present invention, and are not restricted unlike general color photographic materials.

The heat developable color photographic material may be provided with various light-insensitive layers, e.g., a protective layer, an undercoat layer, an interlayer, a yellow filter layer, an antihalation layer, etc., may be provided between silver halide emulsion layers, as the uppermost layer and the lowermost layer. Various auxiliary layers such as a backing layer may be provided on the opposite side of the support. Specifically, layer structures as disclosed in the above patents, an undercoat layer disclosed in U.S. Pat. No. 5,051,335, an interlayer containing a solid pigment disclosed in JP-A-1-167838 and JP-A-61-20943, an interlayer containing a reducing agent and a DIR compound disclosed in JP-A-1-120553, JP-A-5-34884 and JP-A-2-64634, an interlayer containing an electron transferring agent disclosed in U.S. Pat. Nos. 5,017,454, 5,139,919 and JP-A-2-235044, a protective layer containing a reducing agent disclosed in JP-A-4-249245, or a combination of these layers.

A support is preferably designed to have an antistatic function and surface resistivity of $10^{12}$ Ω.cm or less.

When an image obtained by the heat developable color photographic material and the image-receiving material is used as a color-proof for printing, it is required that an image by the heat developable material has no color difference between an image obtained by printing ink. Having no color difference is premised that the color reproduction region of an image obtained by the heat developable color photographic material and the image-receiving material is broader than the color reproduction region of an image obtained by printing ink. This color reproduction region means the color reproduction in every lightness region.

Tints of three dyes of yellow, magenta and cyan to be used, or four dyes including black, or tints of mixed dyes of them are of course important factors determining the color reproduction region of an image obtained by the heat developable color photographic material and the image-receiving material, but the tint of the white part of an image also has an important influence on the color reproduction region.

The white ground of an image obtained by heat development is decided by various factors, e.g., the white ground of the image-receiving material itself, the tints of components transferred from the heat developable color photographic material at heat development, and the tints of components which are colored by heating, if present. Of these factors, the white ground of the image-receiving material itself is an important factor.

The white ground of the image-receiving material itself is decided by the tints of a support, a dye fixing layer, protective layers provided on and under a dye fixing layer, an interlayer, etc. Therefore, how to design the tint of each constitutional component is an important factor.

The white ground of the image-receiving material itself can be controlled by means of adding a coloring component, e.g., a pigment or a dye, to a support, a dye fixing layer, protective layers provided on and under a dye fixing layer, an interlayer, etc. When a support comprising a paper support both sides of which are laminated with polyethylene is used, a method of adding a white pigment such as titanium oxide and magnesium oxide, a bluish pigment such as ultramarine to a paper support or laminated supports can be used. A brightening agent may be added besides coloring components.

For improving the S/N ratio of an image obtained by the heat developable color photographic material and the image-receiving material, materials which generate alkali only during heat development and maintain neutral during storage of materials before and after image formation are preferably used. As such a reaction, two agent reaction of a hardly soluble metal compound and a compound which can react with a metal ion constituting the hardly soluble metal compound to form a complex (a complex-forming compound) is suitable for the object (A method of generating alkali is disclosed in European Patent Publication 210660 and U.S. Pat. No. 4,740,445.).

Specific means for designing the above materials are described below.

First, silver halide emulsions for use in the heat developable color photographic material according to the present invention are described in detail below.

Silver halide emulsions for use in the present invention may be any of silver chloride, silver bromide, silver iodobromide, silver chlorobromide, silver chloroiodide or silver chloroiodobromide.

Silver halide emulsions for use in the present invention may be a surface latent image type emulsion or an internal latent image type emulsion. An internal latent image type emulsion is used as a direct reversal emulsion in combination with a nucleating agent and a light foggant. In addition, a so-called core/shell type emulsion in which the grain interior and the grain surface layer have different phases may be used, or silver halides which have different compositions may be joined by epitaxial junction. Silver halide emulsions may be monodisperse or polydisperse. A method of blending monodisperse emulsions and controlling gradation as disclosed in JP-A-1-167743 and JP-A-4-223463 is preferably used in the present invention. The grain size of silver halide grains is from 0.1 to 2 μm, and particularly preferably from 0.2 to 1.5 μm. Crystal habit of silver halide grains may have a regular crystal form such as a cubic, octahedral or tetradecahedral form, an irregular crystal form such as a spherical form or a tabular form having high aspect ratio, a form which has crystal defects such as twinned crystal planes, or a form which is a composite of these forms and others.

A silver halide photographic emulsion for use in the present invention can be prepared using the methods disclosed, for example, in U.S. Pat. Nos. 4,500,626, 4,628,021, "Research Disclosure" (hereinafter abbreviated to "RD"), No. 17029 (1978), RD No. 17643 (December, 1978), pp. 22 and 23, RD No. 18716 (November, 1979), p. 648, RD No. 307105 (November, 1989), pp. 863 to 865, JP-A-62-253159, JP-A-64-13546, JP-A-2-236546, JP-A-3-110555, P. Glafkides, "Chimie et Physique Photographique", Paul Montel (1967), G. F. Duffin, "Photographic Emulsion Chemistry", Focal Press (1966), and V. L. Zelikman et al., "Making and Coating Photographic Emulsion", Focal Press (1964).

In the process of preparation of a light-sensitive silver halide emulsion according to the present invention, it is preferred to perform desalting for removing excess salt. Desalting may be conducted by a noodle washing method by gelation of gelatin, or a precipitation method using inorganic salts comprising polyvalent anions (e.g., sodium sulfate), anionic surfactants, anionic polymers (e.g., sodium polystyrenesulfonate), or gelatin derivatives (e.g., aliphatic acylated gelatin, aromatic acylated gelatin, aromatic carbamoylated gelatin). A precipitation method is preferably used.

A light-sensitive silver halide emulsion for use in the present invention may contain heavy metals, e.g., iridium, rhodium, platinum, cadmium, zinc, thallium, lead, iron, osmium, etc., for various purposes. These compounds may be used alone or in combination of two or more. The addition amount varies depending on the use purpose but is generally from about $10^{-9}$ to $10^{-3}$ mol per mol of the silver halide. They may be added in the grain uniformly or may be present locally on the surface or in the interior of the grain. Specifically, emulsions disclosed in JP-A-2-236542, JP-A-1-116637, and JP-A-5-181246 are preferably used.

In the grain formation stage of a light-sensitive silver halide emulsion of the present invention, a silver halide solvent such as rhodan salt, ammonia, or tetra-substituted thioether compounds, organic thioether derivatives disclosed in JP-B-47-11386, or sulfur-containing compounds disclosed in JP-A-53-144319 can be used.

With respect to other conditions, the description in the above P. Glafkides, "Chimie et Physique Photographique", Paul Montel (1967), G. F. Duffin, "Photographic Emulsion Chemistry", Focal Press (1966), and V. L. Zelikman et al., "Making and Coating Photographic Emulsion", Focal Press (1964) can be referred to. That is, any process, such as an acid process, a neutral process, and an ammoniacal process can be used. A single jet method, a double jet method, and a combination of these methods are known as methods for reacting a soluble silver salt with a soluble halide, and any of these methods can be used. A double jet method is preferably used for obtaining a monodisperse emulsion.

A reverse mixing method in which grains are formed in the presence of excess silver ion can also be used. A method in which the pAg in the liquid phase in which the silver halide is formed is kept constant, that is, the controlled double jet method, can also be used as one type of the double jet method.

For accelerating the grain growth, the addition concentration, the addition amount and the addition rate of silver salt and halide may be increased (e.g., JP-A-55-142329, JP-A-55-158124 and U.S. Pat. No. 3,650,757).

Any well-known stirring means can be used for stirring a reaction solution. The temperature and pH during formation of silver halide grains may be set up arbitrarily according to purposes. pH is preferably from 2.2 to 8.5, more preferably from 2.5 to 7.5.

A light-sensitive silver halide emulsion of the present invention is generally chemically sensitized. For the chemical sensitization of a light-sensitive silver halide emulsion of the present invention, conventionally known sensitization in general photographic material such as chalcogen sensitization, e.g., sulfur sensitization, selenium sensitization and tellurium sensitization, and noble metal sensitization using gold, platinum and palladium, and reduction sensitization can be used alone or in combination (e.g., JP-A-3-110555 and JP-A-5-241267). Chemical sensitization can be carried out in the presence of a nitrogen-containing compound (e.g., JP-A-62-253159). Further, an antifoggant which is described later can be added after termination of chemical sensitization. Specifically, methods disclosed in JP-A-5-45833 and JP-A-62-40446 can be used.

The pH during chemical sensitization is preferably from 5.3 to 10.5, more preferably from 5.5 to 8.5, and pAg is preferably from 6.0 to 10.5, more preferably from 6.8 to 9.0.

The coating amount of a light-sensitive silver halide emulsion for use in the present invention is from 1 mg/m$^2$ to 10 g/m$^2$ calculated in terms of silver.

For imparting spectral sensitivity of green sensitivity, red sensitivity and infrared sensitivity to a light-sensitive silver halide emulsion for use in the present invention, a light-sensitive silver halide emulsion is spectrally sensitized using methine dyes and other dyes. If necessary, a blue-sensitive emulsion may be spectrally sensitized in a blue region.

Dyes which are used include a cyanine dye, a merocyanine dye, a complex cyanine dye, a complex merocyanine dye, a holopolar cyanine dye, a hemicyanine dye, a styryl dye, and a hemioxonol dye.

Specifically, sensitizing dyes disclosed in U.S. Pat. No. 4,617,257, JP-A-59-180550, JP-A-64-13546, JP-A-5-45828 and JP-A-5-45834 can be exemplified.

These sensitizing dyes can be used either alone or in combination, and a combination of sensitizing dyes is often used, in particular, for the purpose of supersensitization and the wavelength control of spectral sensitivity.

A dye having no spectral sensitizing function by itself or a compound which does not substantially absorb visible light but shows supersensitization may be contained in an emulsion together with sensitizing dyes (e.g., those disclosed in U.S. Pat. No. 3,615,641 and JP-A-63-23145).

These sensitizing dyes may be added to an emulsion before, during or after chemical sensitization, alternatively they may be added before or after the nucleation of silver halide grains as disclosed in U.S. Pat. Nos. 4,183,756 and 4,225,666. Sensitizing dyes and supersensitizers may be added as a solution of organic solvent, e.g., methanol, as a gelatin dispersion, or as a solution of surfactant. The addition amount is generally from about $10^{-8}$ to $10^{-2}$ mol per mol of the silver halide.

Additives for use in these processes and well-known photographic additives which can be used in the heat developable color photographic material and the image-receiving material of the present invention are described in the above "Research Disclosure", No. 17643, No. 18716 and No. 307105, and the locations related thereto are summarized in the table below.

| Type of Additives | RD 17643 | RD 18716 | RD 307105 |
|---|---|---|---|
| 1. Chemical Sensitizers | page 23 | page 648, right column | page 866 |
| 2. Sensitivity Increasing Agents | — | page 648, right column | — |
| 3. Spectral Sensitizers and Supersensitizers | pages 23–24 | page 648, right column to page 649, right column | pages 866–868 |
| 4. Brightening Agents | page 24 | page 648, right column | page 868 |
| 5. Antifoggants and Stabilizers | page 24–25 | page 649, right column | pages 868–870 |
| 6. Light Absorbers, Filter Dyes, and Ultraviolet Absorbers | pages 25–26 | page 649, right column to page 650, left column | page 873 |
| 7. Dye Image Stabilizers | page 25 | page 650, left column | page 872 |
| 8. Hardening Agents | page 26 | page 651, left column | pages 874–875 |
| 9. Binders | page 26 | page 651, left column | pages 873–874 |
| 10. Plasticizers and Lubricants | page 27 | page 650, right column | page 876 |
| 11. Coating Aids and Surfactants | pages 26–27 | page 650, right column | pages 875–876 |
| 12. Antistatic Agents | page 27 | page 650, right column | pages 876–877 |
| 13. Matting Agents | — | — | pages 878–879 |

Hydrophilic binders are preferably used as a binder in the constitutional layers of the heat developable color photographic material and the image-receiving material of the present invention. Examples are described in the above Research Disclosures and JP-A-64-13546, pp. 71 to 75. Specifically, transparent or translucent hydrophilic binders are preferably used, for example, natural compounds such as proteins, e.g., gelatin and gelatin derivatives, polysaccharides, e.g., cellulose derivatives, starch, gum arabic, dextran, and pluran, and synthetic high polymers, e.g., polyvinyl alcohol, polyvinyl pyrrolidone, and acrylamide. Further, highly water-soluble polymers disclosed in U.S. Pat. No. 4,960,681 and JP-A-62-245260, i.e., homopolymers of a vinyl monomer having —COOM or —$SO_3M$ (wherein M represents a hydrogen atom or alkali metal), or copolymers of this monomer unit or with other vinyl monomer (e.g., sodium methacrylate, ammonium methacrylate, Sumikagel L-5H a product of Sumitomo Chemical Co., Ltd.) can also be used. These binders can be used in combination of two or more. Combinations of gelatin with above binders are particularly preferred. Gelatin may be selected according to purposes from lime-processed gelatin, acid-processed gelatin, or a so-called delimed gelatin in which the contents of calcium, etc., are reduced, and it is also preferred to use these gelatins in combination.

When a system of carrying out heat development with supplying a trace amount of water is employed, it becomes possible to expedite water absorption by using the above highly water-soluble polymer. Further, different from the present invention, when a highly water-soluble polymer is used in a dye fixing layer or protective layers thereof, retransferring of dyes from the image-receiving layer to others after transfer can be prevented.

The coating amount of a binder in the present invention is preferably 20 g/$m^2$ or less, more preferably 10 g/$m^2$ or less, and most preferably from 7 g to 0.5 g/$m^2$.

In the present invention, organic metal salt can be used as an oxidizing agent together with a light-sensitive silver halide emulsion. Of such organic metal salts, organic silver salt is particularly preferably used.

Examples of organic compounds which can be used for forming the above organic silver salt oxidizing agent include benzotriazoles, fatty acid, and other compounds disclosed in U.S. Pat. No. 4,500,626, columns 52 and 53. Acetylene silver disclosed in U.S. Pat. No. 4,775,613 is also useful. Two or more organic silver salts may be used in combination.

The above organic silver salts can be used in combination in an amount of from 0.01 to 10 mol, preferably from 0.01 to 1 mol, per mol of the light-sensitive silver halide. The total coating amount of the light-sensitive silver halide emulsion and the organic silver salt is from 0.05 to 10 g/$m^2$, preferably from 0.1 to 4 g/$m^2$, calculated in terms of silver.

As reducing agents for use in the present invention, reducing agents known in the field of the heat developable color photographic material can be used. In addition, the dye-donating compounds having reductivity described later can be included in the reducing agent (in such a case, other reducing agents can be used in combination). Further, reducing agent precursors which themselves do not have reductivity but show reductivity during the process of development by the action of a nucleophilic reagent and heat can also be used.

Examples of reducing agents which can be used in the present invention include reducing agents and reducing agent precursors disclosed in U.S. Pat. Nos. 4,500,626, columns 49 and 50, 4,839,272, 4,330,617, 4,590,152, 5,017,454, 5,139,919, JP-A-60-140335, pp. 17 and 18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546, pp. 40 to 57, JP-A-1-120553, JP-A-2-32338, JP-A-2-35451, JP-A-2-234158, JP-A-3-160443, and European Patent 220746, pp. 78 to 96.

Combinations of various reducing agents as disclosed in U.S. Pat. No. 3,039,869 can also be used.

When diffusion-resisting reducing agents are used, if required, an electron transferring agent and/or a precursor of an electron transferring agent can be used in combination to accelerate electron transfer between a diffusion-resisting reducing agent and developable silver halide. Electron transferring agents disclosed in U.S. Pat. No. 5,139,919, European Patent Publication 418743, JP-A-1-138556 and JP-A-3-102345 are particularly preferably used. A method of stably introducing an electron transferring agent to the layer as disclosed in JP-A-2-230143 and JP-A-2-235044 is preferably used.

Electron transferring agents or the precursors thereof can be selected from among the above-described reducing agents or precursors thereof. It is preferred for the electron transferring agent or the precursor thereof to have transferability larger than that of the diffusion-resisting reducing agent (an electron donor). Particularly preferred electron transferring agents are 1-phenyl-3-pyrazolidones or aminophenols.

In the above-described reducing agents, diffusion-resisting reducing agents (electron donors) to be used in combination with an electron transferring agent are enough if they substantially do not transfer in the layer of a photographic material, preferably hydroquinones, sulfonamidophenols, sulfonamidonaphthols, compounds disclosed in JP-A-53-110827, U.S. Pat. Nos. 5,032,487, 5,026,634 and 4,839,272 as electron donors, and diffusion-resisting-dye-donating compounds having reductivity as described later can be cited.

Electron donor precursors disclosed in JP-A-3-160443 are also preferably used.

The above-described reducing agents can be used in an interlayer or a protective layer for various purposes such as color mixing prevention, color reproduction improvement, whiteness improvement, prevention of silver transfer to an image-receiving material and the like. Specifically, reducing agents disclosed in European Patent Publications 524649, 357040, JP-A-4-249245, JP-A-2-64633, JP-A-2-46450 and JP-A-63-186240 are preferably used. Development inhibitor releasing reducing compounds disclosed in JP-B-3-63733, JP-A-1-150135, JP-A-2-110557, JP-A-2-64634, JP-A-3-43735, European Patent Publication 451833 are also used.

The total addition amount of reducing agents in the present invention is from 0.01 to 20 mol, particularly preferably from 0.1 to 10 mol, per mol of the silver.

Hydrophobic additives such as a dye-donating compound and a diffusion-resisting reducing agent can be introduced into the layer of the heat developable photographic material by well-known methods as disclosed in U.S. Pat. No. 2,322,027. In such a case, a high boiling point organic solvent disclosed in U.S. Pat. Nos. 4,555,470, 4,536,466, 4,536,467, 4,587,206, 4,555,476, 4,599,296, and JP-B-3-62256 can be used in combination with a low boiling point organic solvent having a boiling point of from 50 to 160° C., according to necessity. These dye-donating compound, diffusion-resisting reducing agent and high boiling point organic solvent can be used in combination of two or more.

The amount of a high boiling point organic solvent is 10 g or less, preferably 5 g or less, and more preferably from 1 g to 0.1 g, per gram of the dye-donating compound used. Further, the content is 1 ml or less, preferably 0.5 ml or less, and particularly preferably 0.3 ml or less, per gram of the binder.

These additives can also be added as a dispersion by a polymerization product as disclosed in JP-B-51-39853 and JP-A-51-59943 and as a fine particle dispersion as disclosed in JP-A-62-30242.

When compounds are substantially water-insoluble, they can be added as a fine particle dispersion in a binder, besides the above methods.

Various surfactants can be used for dispersing a hydrophobic compound in hydrophilic colloid. For example, surfactants as disclosed in JP-A-59-157636, pp. 37 and 38 and the above Research Disclosures.

A compound aiming at activation of development and, at the same time, stabilization of the image can be used in the heat developable color photographic material according to the present invention. Specific examples of compounds preferably used are disclosed in U.S. Pat. No. 4,500,626, pp. 51 and 52.

In an image forming system by diffusion transferring of a dye, various compounds can be added to constitutional layers of the heat developable color photographic material of the present invention for the purpose of immobilizing unnecessary colors or colorants or making unnecessary colors or colorants colorless to improve the whiteness of the image obtained.

Specifically, compounds disclosed in European Patent Publications 353741, 461416, JP-A-63-163345 and JP-A-62-203158 can be used.

A variety of pigments and dyes can be used in constitutional layers of the heat developable color photographic material of the present invention for improving a color isolating property and increasing sensitivity.

Specifically, compounds described in the above Research Disclosures and compounds and layer constitutions disclosed in European Patent Publications 479167, 502508, JP-A-1-167838, JP-A-4-343355, JP-A-2-168252, JP-A-61-20943, European Patent Publications 479167 and 502508 can be used.

In an image forming system by diffusion transfer of a dye, the image-receiving material is used together with the heat developable color photographic material. The image-receiving material may be coated on a different support from the support of a color photographic material or may be coated on the same support as the support of a color photographic material. The mutual relationship between a photographic material and an image-receiving material, the relationships with a support and with a white reflecting layer disclosed in U.S. Pat. No. 4,500,626, column 57 can be applied to the present invention.

The image-receiving material preferably used in the present invention has at least one layer containing a mordant and a binder. Known mordants in the photographic field can be used in the present invention. Mordants disclosed in U.S. Pat. No. 4,500,626, columns 58 and 59, JP-A-61-88256, pp. 32 to 41, JP-A-1-161236, pp. 4 to 7, U.S. Pat. Nos. 4,774,162, 4,619,883, and 4,594,308 can be cited as specific examples. Dye-accepting high polymers disclosed in U.S. Pat. No. 4,463,079 can also be used.

The above-described hydrophilic binders are preferably used in the image-receiving material according to the present invention. Further, it is preferred to use carrageenans disclosed in European Patent Publication 443529 and latexes having a glass transition point of 40° C. or less disclosed in JP-B-3-74820 in combination.

The image-receiving material can be provided with an auxiliary layer such as a protective layer, a peeling-off layer, an undercoat layer, an interlayer, a backing layer, a curl preventive layer and the like. In particular, the provision of a protective layer is useful.

A plasticizer, a sliding agent, or a high boiling point organic solvent as an improver of a peeling property of a photographic material and an image-receiving material can be used in constitutional layers of the heat developable color photographic material and the image-receiving material of the present invention. Specific examples are disclosed in the above Research Disclosures and JP-A-62-245253.

Further, various kinds of silicone oils (every kind of silicone oil from dimethylsilicon oil to modified silicone oil such as dimethylsiloxane having incorporated therein various organic groups) can be used for the above purpose. As examples, various kinds of modified silicone oils described in "Modified Silicone Oils", technical information, pp. 6 to 18B, published by Shin-Etsu Silicone Co. Ltd., in particular, a carboxy-modified silicone oil (trade name: X-22-3710), are useful.

Silicone oils disclosed in JP-A-62-215953 and JP-A-63-46449 are also useful.

A discoloration inhibitor may be used in the heat developable color photographic material and the image-receiving material of the present invention. A discoloration inhibitor includes, e.g., an antioxidant, an ultraviolet absorber or a certain kind of a metal complex. Dye image stabilizers and ultraviolet absorbers described in the above Research Disclosures are also useful.

Examples of antioxidants include, e.g., a chroman based compound, a coumaran based compound, a phenol based compound (e.g., hindered phenols), a hydroquinone derivative, a hindered amine derivative and a spiroindane based compound. Compounds disclosed in JP-A-61-159644 can also be useful.

Examples of ultraviolet absorbers include a benzotriazole based compound (e.g., U.S. Pat. No. 3,533,794, etc.), a 4-thiazolidone based compound (e.g., U.S. Pat. No. 3,352,681, etc.), a benzophenone compound (e.g., JP-A-46-2784, etc.), and other compounds disclosed in JP-A-54-48535, JP-A-62-136641 and JP-A-61-88256. Further, ultraviolet absorbing polymers disclosed in JP-A-62-260152 are also useful.

Examples of metal complexes which can be used in the present invention include compounds disclosed in U.S. Pat. Nos. 4,241,155, 4,245,018, columns 3 to 36, 4,254,195, columns 3 to 8, JP-A-62-174741, JP-A-61-88256, pp. 27 to 29, JP-A-63-199248, JP-A-1-75568 and JP-A-1-74272.

A discoloration inhibitor for preventing discoloration of dyes transferred to the image-receiving material may be contained in the image-receiving material in advance or may be supplied to the image-receiving material from the outside, e.g., from the heat developable photographic material or a transfer solvent, which is described later.

An antioxidant, an ultraviolet absorber and a metal complex may be used in combination of them.

The heat developable color photographic material and the image-receiving material of the present invention may contain a brightening agent. In particular, it is preferred to incorporate a brightening agent into the image-receiving material or supplied from the outside, e.g., from the heat developable photographic material or a transfer solvent. Compounds disclosed in K. Veenkataraman, "The Chemistry of Synthetic Dyes", Vol. V, Chap. 8, and JP-A-61-143752 can be cited as examples of a brightening agent. Specifically, a stilbene based compound, a coumarin based compound, a biphenyl based compound, a benzoxazoline based compound, a naphthalimide based compound, a pyrazoline based compound, and a carbostyril based compound can be cited.

A brightening agent can be used in combination with a discoloration inhibitor and an ultraviolet absorber.

Specific examples of discoloration inhibitors, ultraviolet absorbers and brightening agents are disclosed in JP-A-62-215272, pp. 125 to 137, and JP-A-1-161236, pp. 17 to 43.

As a hardening agent for use in constitutional layers of the heat developable color photographic material and the image-receiving material of the present invention, hardening agents disclosed in the above Research Disclosures, U.S. Pat. No. 4,678,739, column 41, 4,791,042, JP-A-59-116655, JP-A-62-245261, JP-A-61-18942 and JP-A-4-218044 can be cited. More specifically, an aldehyde based hardening agent (e.g., formaldehyde), an aziridine based hardening agent, an epoxy based hardening agent, a vinyl sulfone based hardening agent (e.g., N,N'-ethylene-bis (vinylsulfonylacetamide)ethane), an N-methylol based hardening agent (e.g., dimethylolurea), or a high polymer hardening agent (e.g., compounds disclosed in JP-A-62-234157) can be enumerated.

The use amount of these hardening agents is from 0.001 to 1 g, preferably from 0.005 to 0.5 g, per gram of the coated gelatin. A hardening agent may be added to any constitutional layer of the photographic material and the image-receiving material, and may be added to two or more layers dividedly.

Constitutional layers of the heat developable color photographic material and the image-receiving material of the present invention can contain various antifoggants, photographic stabilizers and precursors thereof. Specific examples of these compounds are disclosed in the above Research Disclosures, U.S. Pat. Nos. 5,089,378, 4,500,627, 4,614,702, JP-A-64-13546, pp. 7 to 9, 57 to 71 and 81 to 97, U.S. Pat. Nos. 4,775,610, 4,626,500, 4,983,494, JP-A-62-174747, JP-A-62-239148, JP-A-63-264747, JP-A-1-150135, JP-A-2-110557, JP-A-2-178650, and "RD", 17643 (1978), pp. 24 and 25.

These compounds are used in an amount of preferably from $5\times10^{-6}$ to $1\times10^{-1}$ mol, more preferably from $1\times10^{-5}$ to $1\times10^{-2}$ mol, per mol of the silver.

Various surfactants can be used in constitutional layers of the heat developable color photographic material and the image-receiving material of the present invention for various purposes such as coating aid, improvement of peeling-off property, improvement of sliding property, static prevention, and development acceleration. Specific examples of surfactants are disclosed in the above Research Disclosures, JP-A-62-173463 and JP-A-62-183457, etc.

An organic fluoro compound can be contained in constitutional layers of the heat developable color photographic material and the image-receiving material of the present invention for purposes of improvement of sliding property, static prevention, and improvement of peeling-off property. Representative examples of organic fluoro compounds include fluorine based surfactants disclosed in JP-B-57-9053, columns 8 to 17, JP-A-61-20944 and JP-A-62-135826, and a hydrophobic fluorine compound, such as an oily fluorine based compound such as a fluorine oil, or a solid fluorine compound resin such as a tetrafluoroethylene resin.

A matting agent can be used in the heat developable color photographic material and the image-receiving material of the present invention for purposes of adhesion prevention and improvement of sliding property. Examples of matting agents include compounds such as benzoguanamine resin beads, polycarbonate resin beads, and AS resin beads disclosed in JP-A-63-274944 and JP-A-63-274952, besides compounds such as silicon dioxide, polyolefin and polymethacrylate disclosed on p. 29 of JP-A-61-88256. In addition to the above, compounds disclosed in the above Research Disclosures can be used.

Moreover, a thermal solvent, a defoaming agent, a fungicide, a biocide, colloidal silica, etc., may be contained in constitutional layers of the heat developable color photographic material and the image-receiving material of the present invention. Specific examples of these additives are disclosed on pp. 26 to 32 of JP-A-61-88256, JP-A-3-11338 and JP-B-2-51496.

An image-forming accelerator can be used in the heat developable color photographic material and/or the image-receiving material according to the present invention. An image-forming accelerator has functions of acceleration of the oxidation reduction reaction of a silver salt oxidizing agent and a reducing agent, acceleration of reactions such as formation of a dye from a dye-donating compound, decomposition of a dye, or release of a diffusible dye, and acceleration of dye transfer from the heat developable photographic material layer to a dye-fixing layer. An image-forming accelerator is classified, from physicochemical functions, into a base, a base precursor, a nucleophilic compound, a high boiling point organic solvent (oil), a thermal solvent, a surfactant, a compound having correlation with silver or silver ion. However, these material groups have, in general, composite function and invested with some of the above acceleration effects. Details thereof are disclosed in U.S. Pat. No. 4,678,739, columns 38 to 40.

A base precursor includes an organic acid and a salt of a base decarboxylated by heat, a compound releasing amines by intramolecular nucleophilic substitution reaction, Lossen rearrangement, or Beckmann rearrangement. Specific examples are disclosed in U.S. Pat. Nos. 4,511,493 and 4,657,848.

In a system performing heat development and dye transfer simultaneously in the presence of a small amount of water, it is preferred to incorporate a base and/or a base precursor in the image-receiving material in view of increasing the storage stability of the heat developable photographic material.

In addition to the above, combinations of hardly-soluble metal compounds and compounds which can react with metal ions constituting these hardly soluble metal compounds to form complexes (complex-forming compounds) disclosed in European Patent Publication 210660 and U.S. Pat. No. 4,740,445, and compounds which generate a base by electrolysis disclosed in JP-A-61-232451 can also be used as a base precursor. In particular, the former method is effective. These hardly-soluble metal compound and complex-forming compound are preferably added to the heat developable photographic material and the image-receiving material separately as disclosed the above patents.

A variety of development stopping agents can be used in the heat developable color photographic material and/or the image-receiving material according to the present invention for the purpose of obtaining constant images irrespective of the fluctuations in the processing temperature and the processing time during development.

A development-stopping agent used herein means a compound which immediately neutralizes a base or reacts with a base to reduce the concentration of the base in the film to thereby stop development, or a compound which correlates with silver and silver salt to inhibit development. Specifically, an acid precursor which releases an acid by heating, an electrophilic compound which undergoes a substitution reaction with the coexisting base by heating, a nitrogen-containing heterocyclic compound, a mercapto compound or a precursor thereof. Details are disclosed on pp. 31 and 32 of JP-A-62-253159.

Supports which can undergo the processing temperature are used for the heat developable color photographic material and the image-receiving material according to the present invention. In general, photographic supports such as paper and a synthetic high polymer (film) described in, for example, compiled by Nihon Shashin Gakkai, "Shashin Kogaku no Kiso, Gin-En Shashin-Hen (The Elementary Course of Photographic Engineering, Section of Silver Photography)", pp. 223 to 240, Corona Publishing Co. (1979) are exemplified. Specifically, polyethylene terephthalate, polyethylene naphthalate, polycarbonate, polyvinyl chloride, polystyrene, polypropylene, polyimide, celluloses (e.g., triacetyl cellulose), or films of these compounds to which a pigment such as titanium oxide is incorporated, synthetic paper of a film such as polypropylene, mixed paper comprising synthetic resin pulp such as polyethylene and natural pulp, yankee paper, baryta paper, coated paper (in particular, cast coated paper), metal, cloth, glass, etc., are used.

They can be used alone, or as a support one or both surfaces of which is (are) laminated with a synthetic high polymer such as polyethylene. A pigment or a dye such as titanium oxide, ultramarine, carbon black, etc., can be added to this laminate layer, if necessary.

In addition to the above, supports disclosed in JP-A-62-253159, pp. 29 to 31, JP-A-1-161236, pp. 14 to 17, JP-A-63-316848, JP-A-2-22651, JP-A-3-56955 and U.S. Pat. No. 5,001,033 can also be used.

Back surfaces of these supports may be coated with a hydrophilic binder and semi-conductive metal oxide such as alumina sol and stannic oxide, and an antistatic agent such as carbon black or the like. Specifically, supports disclosed in JP-A-63-320246 can be used.

Various surface treatments or undercoating are preferably conducted to surfaces of support for the purpose of improving the adhesion property with a hydrophilic binder.

As a method of exposing and recording an image on the heat developable color photographic material, there are a method of directly photographing a landscape or a person using a camera, a method of exposure through a reversal film or a negative film using a printer or an enlarger, a method of scanning exposing an original picture through a slit using an exposing apparatus of a copying machine, a method of scanning exposing an image information via an electric signal by emitting a light emitting diode or various kinds of lasers (e.g., a laser diode, a gas laser) (methods disclosed in JP-A-2-129625, Japanese Patent Application Nos. 3-338182, 4-9388 and 4-281442), and a method of outputting an image information on an image display unit such as a CRT, a liquid crystal display, an electroluminescence display, or a plasma display, and exposing directly or via an optical system.

As a light source for recording an image on the heat developable color photographic material, a natural light, a tungsten lamp, a light emitting diode, a laser light source, and a CRT light source and exposure methods as disclosed in U.S. Pat. No. 4,500,626, column 56, JP-A-2-53378 and JP-A-2-54672 can be used.

In addition, image exposure can be carried out using a wavelength conversion element of a combination of a nonlinear optical material and a coherent light source such as a laser beam, etc. A nonlinear optical element means a substance capable of manifesting nonlinearity between polarization and electric field which appears when strong photoelectric field such as a laser beam is given. Compounds which are preferably used as such compounds include inorganic compounds represented by lithium niobate, potassium dihydrogenphosphate (KDP), lithium iodate, and $BaB_2O_4$, urea derivatives, nitroaniline derivatives, nitropyridine-N-oxide derivatives, e.g., 3-methyl-4-nitropyridine-N-oxide (POM), and compounds disclosed in JP-A-61-53462 and JP-A-62-210432. A monocrystal optical wave guide type and a fiber type are known as the form of a wavelength conversion element and both of them are useful.

A video camera, an image signal obtained from an electron still camera, a television signal represented by Nippon Television Signal Code (NTSC), a picture signal obtained by dividing an original picture into many pixels by a scanner, and an image signal formed using a computer represented by CG and CAD can be used for the above image information.

The heat developable color photographic material and/or the image-receiving material according to the present invention may have an electrically conductive exothermic layer as a heating means of heat development and diffusion transfer of a dye. Exothermic elements disclosed in JP-A-61-145544 can be used in such a case.

The heating temperature in heat development process is about 50° C. to 250° C., in particular, the temperature of from 60° C. to 180° C. is useful. Diffusion transfer process of a dye may be carried out simultaneously with heat development process, or may be conducted after termination of heat development process. In the latter case, dye transfer can be performed at temperature range of from the temperature of heat development process to room temperature but, in particular, to the temperature lower than the temperature of heat development process by 10° C. is preferred.

The transfer of a dye is effected only with heating but a solvent may be used for accelerating the dye transfer. A method of performing development and transfer at the same time or subsequently by heating in the presence of a small amount of a solvent (in particular, water) as disclosed in U.S. Pat. Nos. 4,704,345, 4,740,445, and JP-A-61-238056 is also effective. In this system, heating temperature is preferably 50° C. or more and not higher than the boiling point of a solvent, for example, when water is used as a solvent, the temperature is preferably from 50° C. to 100° C.

As examples of solvents for the acceleration of development and/or the diffusion transfer of a dye, water, a basic aqueous solution containing inorganic alkali metal salt and organic base (those described as accelerating agents of image formation can be used as such a base), a low boiling point solvent, a mixed solution of a low boiling point solvent with water or with the above-described basic aliphatic groups can be cited. Surfactants, antifoggants, complex-forming compounds with hardly soluble metal salts, fungicides, and biocides can be contained in a solvent.

Water is preferably used as a solvent in heat development and diffusion transfer processes, and any water which is generally used as water can be used, e.g., distilled water, tap water, well water, mineral water, etc. In a heat developing processor for the heat developable photographic material and the image-receiving material according to the present invention, water may be non-returnable type or may be used repeatedly by circulating. In the latter case, the water contains the ingredients diluted from the material. Apparatuses or waters disclosed in JP-A-63-144354, JP-A-63-144355, JP-A-62-38460, and JP-A-3-210555 may be used.

A method of conferring a solvent to the heat developable color photographic material or the image-receiving material or both of them can be used. The use amount of a solvent should be sufficient in such an amount as the weight of the solvent corresponding to the maximum swollen volume of the total coated film or less.

Methods of conferring a solvent to the heat developable color photographic material or the image-receiving material disclosed, for example, in JP-A-62-253159, p. 5 and JP-A-63-85544 are preferably used. A solvent can be used being microcapsulated or in the form of a hydrate and previously incorporated into the heat developable color photographic material or the image-receiving material or both of them.

The temperature of water to be conferred should be sufficient in the range of from 30° C. to 60° C. It is preferred to increase the temperature to 45° C. or more for preventing bacteria from proliferating in water.

A method of incorporating a hydrophilic thermal solvent, which is solid at room temperature but dissolves at high temperature, into the heat developable photographic material and/or the image-receiving material can also be used for accelerating dye transfer. A hydrophilic thermal solvent may be incorporated into any layer of a silver halide emulsion layer, an interlayer, a protective layer, or a dye-fixing layer, but is preferably incorporated into a dye-fixing layer and/or adjacent layers thereto.

Examples of hydrophilic thermal solvents include ureas, pyridines, amides, sulfonamides, imides, alcohols, oximes and other heterocyclic compounds.

Heating method in development and/or transfer process include bringing a material into contact with a heated block or plate, a hot plate, a hot presser, a hot roller, a hot drum, a halogen lamp heater, an infrared or far infrared lamp heater, or passing a material through atmosphere of high temperature.

Methods of superposing the heat developable photographic material on the image-receiving material disclosed on p. 27 of JP-A-61-147244 can be applied to the present invention.

Any of various heat developing apparatus can be used for processing a photographic element according to the present invention. For example, apparatuses disclosed in JP-A-59-75247, JP-A-59-177547, JP-A-59-181353, JP-A-60-18951, JP-A-U-62-25944 (the term "JP-A-U" as used herein means an "unexamined published Japanese utility model application"), Japanese Patent Application Nos. 4-277517, 4-243072 and 4-244693 are preferably used. As commercially available apparatuses, Pictrostat 100, Pictrostat 200, Pictrography 300, and Pictrography 200 (a product of Fuji Photo Film Co., Ltd.) can be used.

When the image obtained by the above-described heat developable photographic material and image-receiving material is used as a color-proof for printing, densities may be expressed by any of continuous tone control, areal tone control utilizing discontinuous density parts, or tone control of both in combination.

Output of digital signals becomes feasible by using LD and LED as an exposure light source. As a result, a process (DDCP) of conducting image control such as design and tint of a printed matter on CRT, and outputting a color-proof as a final output becomes feasible. That is, DDCP becomes a effective means for efficiently carrying out output of a proof in the field of color-proof. This is due to the fact that a color printer has a comparatively simple constitution and inexpensive, and also in a color printer, as is well known, preparation of a process film such as in a color printing machine and preparation of a printing plate (PS plate) are not necessary, and a hard copy comprising an image provided on a sheet can be formed in a short time, a plurality of times and easily.

When LD and LED are used as an exposure light source, three spectral sensitivities of yellow, magenta and cyan, or four spectral sensitivities of yellow, magenta, cyan and black, or spectral sensitivity of each color obtained by mixing two or more coloring materials for obtaining a desired hue, are each preferably has a peak of spectral sensitivity in different wavelengths with intervals of 20 nm or more. A method of obtaining an image of two or more colors by one exposure wavelength may be used when the sensitivity difference of spectral sensitivities of two or more different colors is 10 times or more.

A method of reproducing a moire on a printed matter by a color printer is described below.

For producing a color-proof for printing faithfully reproducing a moire appearing on a printed matter of high resolution using a color printer of low resolution, referring to threshold matrix 24 with respect to each of the dot area factor data aj of four printing plates of C, M, Y, and K, each aj is converted to bit map data b'j of 48800 DPI. Then, the area factor ci of each color is counted referring to the bit map data b'j of a certain range at the same time. Subsequently, the first three stimulus value data X, Y and Z of 1600 DPI, which are previously obtained colorimetric data of the above each color, are calculated. These first three stimulus value data X, Y and Z are subjected to anti-areazing filter treatment and the second three stimulus value data X', Y' and Z' of 400 DPI are calculated, and these calculated date are made as input data of a color printer. Details as to the above are disclosed in Japanese Patent Application No. 7-5257.

When a color image is recorded using an output unit such as a color printer etc., it is possible to realize a color image having desired colors by, for example, manipulating color signals concerning yellow, magenta and cyan. However, since the above color signals depend on the output characteristics of the output unit, color signals fed from the outer unit having different characteristics is necessary to be subjected to a color conversion treatment taking the above output characteristics into consideration.

Accordingly, a plurality of already known color patches of different colors are prepared using the output unit, and by the colorimetry of the above color patches, for example, the conversion relationship which converts already known color signals C, M and Y of the above color patches into stimulus signals X, Y and Z not depending upon the output unit (hereinafter this conversion relationship is referred to as "normal conversion relationship") is obtained, then the conversion relationship which converts stimulus signals X, Y and Z into color signals C, M and Y from the above normal conversion relationship (hereinafter this conversion relationship is referred to as "reverse conversion relationship") is found, and the above-described color conversion treatment is conducted using this reverse conversion relationship.

As a method of searching color signals C, M and Y from the above stimulus value signals X, Y and Z, the following three methods can be cited but the present invention is not limited thereto.

(1) A method comprising setting up a tetrahedron with four points of stimulus value signals X, Y and Z being vertexes, dividing the space of stimulus value signals X, Y and Z by this tetrahedron and similarly dividing the space of color signals C, M and Y by the tetrahedron, and finding color signals C, M and Y corresponding to arbitrary stimulus value signals X, Y and Z in the tetrahedron by linear operation;

(2) A method of finding color signals C, M and Y corresponding to arbitrary stimulus value signals X, Y and Z by repeat operation according to Newton's method (ref. "Photographic Science and Engineering", Vol. 16, No. 2 (March–April, 1972), pp. 136 to 143 "Metameric color matching in subtractive color photography");

(3) A method comprising a first step: in a color conversion method of converting color signals from the first color specification series to the second color specification series, the relationship of real color signals in the above first color specification series obtained from already known real color signals in the above second color specification series is found as the first normal conversion relationship; a second step: approximating the above first normal conversion relationship by monotone function and setting up virtual color signals at the outside of the region comprising the above real color signals; a third step: the relationship of the corresponding color signals in the above first color specification series obtained from color signals comprising the above real color signals in the above second color specification series and the above virtual color signals is found as the second normal conversion relationship; and a fourth step: the relationship of color signals in the above first color specification series is found from the above second conversion relationship by repeat operation as reverse conversion relationship. That is, in this conversion method, real color signals in the first color specification series (e.g., X, Y and Z) corresponding to already known real color signals in the second color specification series (e.g., C, M and Y) are calculated with the color conversion method comprising converting color signals from the first color specification series to the second color specification series. Thereafter, the first normal conversion relationship between these real color signals are approximated by monotone function, and virtual color signals are set up at the outside of the region comprising the above real color signal. Reverse conversion relationship converting the above first color specification series to the above second color specification series is found by repeat operation represented by Newton's method from the second normal conversion relationship between the second normal conversion relationship comprising the above real color signals and the above virtual color signals and the first color specification series, and color conversion is conducted using this reverse conversion relationship.

The size of the image obtained by the above heat developable photographic material and image-receiving material may be any of standard size of series A, A1 to A6 sizes, a medium octavo, standard size of series B, B1 to B6 sizes, and a duodecimo. Corresponding to these sizes, the heat developable photographic material and the image-receiving material can take any size within the range of from 100 mm to 2,000 mm in width.

The heat developable photographic material and the image-receiving material may be fed in a roll state or in a sheet state, or either one may be fed in a roll state and the other in a sheet.

The case in which an image obtained by a heat developable color photographic material and an image-receiving material is used as a color-proof for printing is described below but the present invention is not limited thereto.

Proofs, e.g., colors, for correction is conventionally produced by a proofer for printing, e.g., a color printer, prior to the stage using a color printing machine and producing a color print comprising a color image by dot image as a product formed on printing paper (formal paper to become a final product).

The reason for using a proofer for printing is that the a proofer does not require the preparation of a process film such as in a color printing machine and preparation of a printing plate (PS plate), and a hard copy comprising an image provided on a proof sheet, i.e., a proof, can be formed easily a plurality of times in a short time.

For forming a color image for proof on a proof sheet, in the first place, image data dependent on device (printing, photograph, image sensor, CRT, LED, etc.), e.g., C, M, Y and K (cyan, magenta, yellow, black) image data, are once converted into colorimetric value data which are image data non-dependent on device, e.g., X, Y and Z (stimulus values) image data, by standard printing profile (four dimensional look-up table, etc.) given by a maker in advance. Then, the image data dependent on device are converted into image data dependent on device for a color printer, e.g., R, G, and B (red, green and blue), by proofer profile for printing, e.g., printer profile (three dimensional look-up table). Finally, a proof comprising a color image formed on a proof paper is produced by a color printer (a printer for correction) using this image data dependent on device.

According to this procedure, colors of the print by the printing machine can be confirmed at the pre-stage of the actual printing by simulating the proof by the color printer.

The mode of execution of using a photographic material according to the present invention as a proof system is described referring to the figure.

FIG. 1 shows the constitution of printing proof system 10 to which an embodiment of the present invention is applied. Printing proof system 10 has color conversion part 12 comprising a computer. Inputted image data dependent on device, e.g., image data for printing of each color of C, M, Y and K, each of which is dot area percentage, (hereinafter simply referred to as CMYK image data for printing) Iin=Iin(C, M, Y, K) is converted into image data of each color of R, G, B (hereinafter simply referred to as RGB image data) Iout=Iout(R, G, B), then outputted to image output unit as a proofer for printing, e.g., printer 14.

In this case, CMYK image data for printing Iin are separated data by three color separation (RGB→CMYK) of RGB image data obtained from the original image by a print input unit, e.g., scanner 16, at color conversion part 18 comprising a computer so as to be suitable for printability by a print input unit. At color conversion part 18, well known color correction and tone correction are carried out but detailed explanation is omitted as this part is not an important part of the present invention.

Color conversion part 12 connected to output side of color separation part 18 converts image data for printing Iin of each color of C, M, Y and K into one dimensional conversion look up table (hereinafter referred to as LUT) 21 to 24 by which tone of each color of C, M, Y and K is converted, and image data for printing Iin'=Iin(C', M', Y', K') of each color of C, M, Y and K after tone conversion by LUT 21 to 24 into X, Y and Z colorimetric value data Icv=Icv (X, Y, Z) as colorimetric value data which are image data non-dependent on device by standard printing profile 26 as a previously given color conversion means.

Standard print profile 26, as explained in detail later, can separate standard printing profile 26 which is nonlinear four dimensional LUT into linear four dimensional LUT 55 and LUT 51 to 54 with every color of C, M, Y and K showing intrinsic tone (dot gain) characteristics concerning nonlinear part.

Colorimetric value data Icv outputted from profile 26 for printing is converted to R, G and B image data Iout=(R, G, B) by printer profile 36 as a color conversion means.

When RGB image data Iout are supplied to printer 14, proof 42 comprising color print 40 produced by the heat developable photographic material of the present invention, which is paper for the exclusive use as proof for printing not to be printed, having formed thereon image 39 is outputted from printer 14.

As printer 14, a laser printer can be used, which is emitted, for example, corresponding to RGB image data Iout (R is image data corresponding to cyan density and is converted to output data of LD of 750 nm emission; G is image data corresponding to magenta density and is converted to output data of LD of 680 nm emission; and B is image data corresponding to yellow density and is converted to output data of LD of 810 nm emission), and each laser beam of 680 nm, 750 nm and 810 nm strength-converted corresponding to each of RGB image data Iout scans heat developable photographic material 40, thereby latent image is exposed and recorded and a visible image is formed by heat development. Specifically, it is possible to prepare a proof by the combination of various personal computers, appropriate software, files such as LUT and Pictrography 4000 manufactured by Fuji Photo Film Co., Ltd. and the like.

The present invention will be described in greater detail with reference to the following Examples, but the invention should not be construed as being limited thereto.

EXAMPLE 1

Image-Receiving Material M-101 having the constitution shown in Tables 1 and 2 was prepared.

TABLE 1

Constitution of Image-Receiving Material M-101

| | Coating Amount ($mg/m^2$) |
|---|---|
| Sixth Layer | |
| Water-soluble polymer (1) | 130 |
| Water-soluble polymer (2) | 35 |
| Water-soluble polymer (3) | 45 |
| Potassium nitrate | 20 |
| Anionic surfactant (1) | 6 |
| Anionic surfactant (2) | 6 |
| Amphoteric surfactant (1) | 50 |
| Antistaining agent (1) | 7 |
| Antistaining agent (2) | 12 |
| Matting agent (1) | 7 |
| Fifth Layer | |
| Acid-processed gelatin | 170 |
| Water-soluble polymer (5) | 35 |
| Anionic surfactant (3) | 6 |
| Matting agent (2) | 140 |
| Hardening agent (1) | 60 |
| Fourth Layer | |
| Mordant (1) | 1,850 |
| Water-soluble polymer (2) | 260 |
| Water-soluble polymer (4) | 1,400 |
| Latex dispersion (1) | 600 |
| Anionic surfactant (3) | 25 |
| Nonionic surfactant (1) | 18 |
| Guanidine picolinate | 2,550 |
| Sodium quinolinate | 350 |
| Third Layer | |
| Gelatin | 370 |
| Mordant (1) | 300 |
| Anionic surfactant (3) | 12 |
| Second Layer | |
| Gelatin | 700 |
| Mordant (1) | 290 |
| Water-soluble polymer (1) | 55 |
| Anionic surfactant (3) | 13 |
| Anionic surfactant (4) | 2 |
| High boiling point organic solvent (1) | 175 |
| Brightening agent (1) | 2 |
| Antistaining agent (3) | 8 |
| Guanidine picolinate | 360 |
| Potassium quinolinate | 45 |
| First Layer | |
| Acid-processed gelatin | 290 |
| Anionic surfactant (1) | 16 |
| Sodium metaborate | 45 |

TABLE 1-continued

| Constitution of Image-Receiving Material M-101 | Coating Amount ($mg/m^2$) |
|---|---|
| Matting agent (3) | 274 |
| Hardening agent (1) | 310 |
| Support (1) | |
| Paper support laminated with polyethylene having a thickness of 215 $\mu$m | |

The coating amount of a latex dispersion is a coating amount of solid content of latex.

TABLE 2

| Constitution of Support (1) | Film Thickness ($\mu$m) |
|---|---|
| Surface Undercoat Layer | |
| Gelatin | 0.1 |
| Surface PE Layer (glossy) | |
| Low density polyethylene: 90.2 parts (density: 0.923)<br>Surface-treated titanium oxide: 9.8 parts<br>Ultramarine: 0.001 part | 36.0 |
| Pulp Layer | |
| High quality paper (LBKP/NBSP = 6/4 density: 1.053) | 152.0 |
| Back Surface PE Layer (matted) | |
| High density polyethylene (density: 0.955) | 27.0 |
| Back Surface Undercoat Layer | |
| Styrene/acrylate copolymer<br>Colloidal silica<br>Sodium polystyrenesulfonate | 0.1 |
| total | 215.2 |

Anionic Surfactant (1)

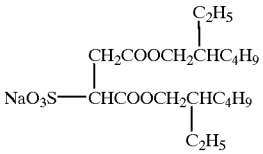

Anionic Surfactant (2)

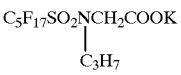

Anionic Surfactant (3)

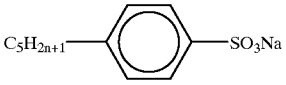

$n \approx 12.6$

Anionic Surfactant (4)

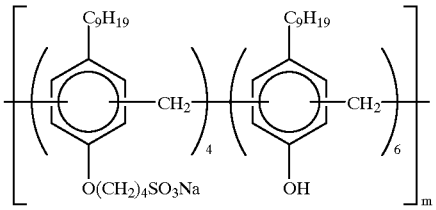

$m = 6.8$

Nonionic Surfactant (1)

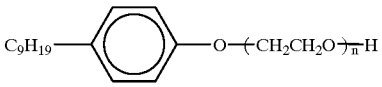

$n = 50$

Amphoteric Surfactant (1)

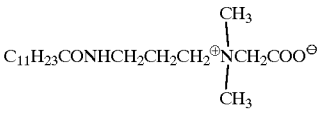

Brightening Agent

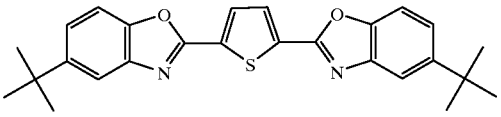

Mordant (1)

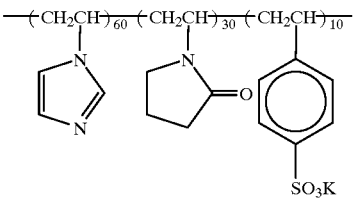

Antistaining Agent (1)

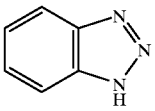

Antistaining Agent (2)

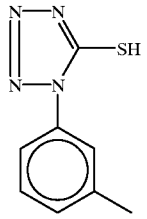

Antistaining Agent (3)

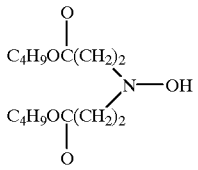

High Boiling Point Organic Solvent (1)

$C_{28}H_{46.9}Cl_{7.1}$

Empara 40 (a product of Ajinomoto Co., Ltd.)

Water-Soluble Polymer (1)

Sumikagel L5-H (a product of Sumitomo Chemical Co., Ltd.)

Water-Soluble Polymer (2)

Dextran (molecular weight: 70,000)

Water-Soluble Polymer (3)

Kappa-carrageenan (a product of Taito Co., Ltd.)

Water-Soluble Polymer (4)

MP Polymer, MP-102 (a product of Kuraray Co., Ltd.)

Water-Soluble Polymer (5)

Acryl-modified copolymer of polyvinyl alcohol (modification degree: 17%)

Latex Dispersion (1)

LX-438 (a product of Nippon Zeon Co., Ltd.)

Matting Agent (1)

SYLOID 79 (a product of Fuji Davison Co., Ltd.)

Matting Agent (2)

PMMA particles (average particle size: 3 μm)

Matting Agent (3)

PMMA particles (average particle size: 4 μm)

Hardening Agent

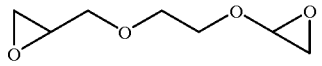

A method of preparing a heat developing photographic material is described below.

In the first place, a method of preparing a light-sensitive silver halide emulsion is described below.

Light-Sensitive Silver Halide Emulsion (1) (an emulsion for the fifth layer (680 nm light-sensitive layer)

Solutions I and II having the compositions shown in Table 4 were simultaneously added to the aqueous solution having the composition shown in Table 3 with thoroughly stirring over 9 minutes. Five minutes after the termination of the addition of Solution I, Solutions III and IV having the compositions shown in Table 4 were added to the above mixed solution over 33 minutes.

TABLE 3

| Composition | |
|---|---|
| $H_2O$ | 620 ml |
| Lime-processed gelatin | 20 g |
| KBr | 0.3 g |
| NaCl | 2 g |
| Silver halide solvent (1) | 0.030 g |
| Sulfuric acid (1N) | 16 ml |
| Temperature: 50° C. | |

TABLE 4

| | Solution (I) | Solution (II) | Solution (III) | Solution (VI) |
|---|---|---|---|---|
| $AgNO_3$ | 30.0 g | — | 70.0 g | — |
| KBr | — | 13.7 g | — | 44.2 g |
| NaCl | — | 3.62g | — | 2.4 g |
| $K_2IrCl_6$ | — | — | — | 0.031mg |
| Total | Water to make 126 ml | Water to make 132 ml | Water to make 254 ml | Water to make 252 ml |

Silver Halide Solvent (1)

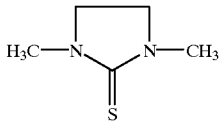

Fifteen minutes after the beginning of the addition of solution (III), 135 ml of an aqueous solution containing 0.350% of Sensitizing Dye (1) was added to the above reaction solution over 19 minutes.

The above solution was washed and desalted (precipitant a was used at pH of 3.6) by ordinary methods, then 22 g of lime-processed ossein gelatin, 0.30 g of NaCl and an appropriate amount of NaOH were added and pH and pAg were adjusted to 6.0 and 7.9, respectively, and chemically sensitized at 60° C. Compounds used for chemical sensitization are shown in Table 5. The yield of the-thus obtained emulsion was 675 g. The emulsion was monodisperse cubic silver chlorobromide emulsion having a variation coefficient of 10.2%, an average grain size of 0.25 μm, pH of 6.15 (40° C.), viscosity of 5.4 centipoise (40° C.).

Sensitizing Dye (1)

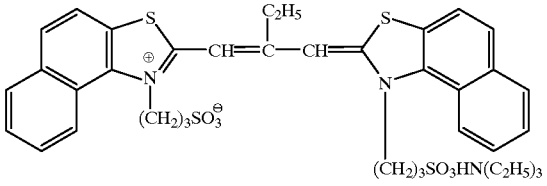

TABLE 5

| Compound used for chemical sensitization | Addition amount |
|---|---|
| 4-Hydroxy-6-methyl-1,3,3a,7-tetraazaindene | 0.29 g |
| Sodium thiosulfate | 5.95 mg |
| Antifoggant (1) | 0.09 g |

TABLE 5-continued

| Compound used for chemical sensitization | Addition amount |
|---|---|
| Antifoggant (2) | 0.03 g |
| Preservative (1) | 0.07 g |
| Preservative (2) | 3.13 g |

Precipitant a

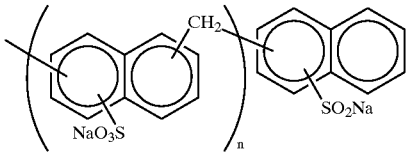

Precipitant b

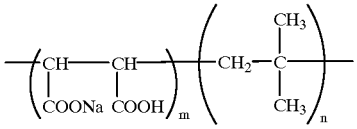

Antifoggant (1)

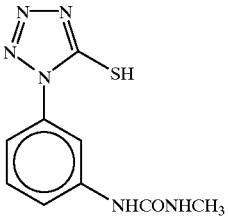

Preservative (1)

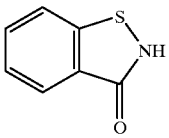

Preservative (2)

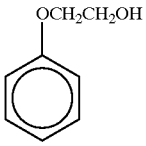

Antifoggant (2)

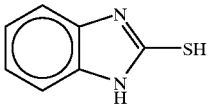

Light-Sensitive Silver Halide Emulsion (2) (an emulsion for the third layer (750 nm light-sensitive layer)

Solutions I and II having the compositions shown in Table 7 were simultaneously added to the aqueous solution having the composition shown in Table 6 with thoroughly stirring over 18 minutes. Five minutes after the termination of the addition of Solution I, Solutions III and IV having the compositions shown in Table 7 were added to the above mixed solution over 24 minutes.

TABLE 6

| Composition | |
|---|---|
| $H_2O$ | 620 ml |
| Lime-processed gelatin | 20 g |
| KBr | 0.3 g |
| NaCl | 2 g |
| Silver halide solvent (1) | 0.030 g |
| Sulfuric acid (1N) | 16 ml |
| Temperature: 45° C. | |

TABLE 7

| | Solution (I) | Solution (II) | Solution (III) | Solution (VI) |
|---|---|---|---|---|
| $AgNO_3$ | 30.0 g | — | 70.0 g | — |
| KBr | — | 13.7 g | — | 44.2 g |
| NaCl | — | 3.62g | — | 2.4 g |
| K2[Fe(CN)6].$H_2O$ | — | — | — | 0.07 g |
| $K_2IrCl_6$ | — | — | — | 0.040mg |
| | Water to make | Water to make | Water to make | Water to make |
| Total | 188 ml | 188 ml | 250 ml | 250 ml |

The above solution was washed and desalted (precipitant b was used at pH of 3.6) by ordinary methods, then 22 g of lime-processed ossein gelatin which had been subjected to calcium removal treatment (content of calcium: 150 ppm or less) was added and redispersed at 40° C. Subsequently, 0.39 g of 4-hydroxy-6-methyl-1,3,3a,7-tetraazaindene was added and pH and pAg were adjusted to 5.9 and 7.8, respectively, and chemically sensitized at 60° C. Compounds used for chemical sensitization are shown in Table 8. At the final stage of chemical sensitization, a methanol solution containing Sensitizing Dye (2) was added (composition of the solution is shown in Table 9). After chemical sensitization, the temperature was lowered to 50° C. and 200 g of a gelatin dispersion of Stabilizer (1) shown below was added and stirred for 10 minutes and the emulsion was recovered. The yield of the-thus obtained emulsion was 938 g. The emulsion was monodisperse cubic silver chlorobromide emulsion having a variation coefficient of 12.6%, an average grain size of 0.25 $\mu$m.

TABLE 8

| Compound used for chemical sensitization | Addition amount |
|---|---|
| 4-Hydroxy-6-methyl-1,3,3a,7-tetraazaindene | 0.30 g |
| Triethylthiourea | 3.2 mg |
| Nucleic acid dispersion | 0.39 g |
| NaCl | 0.15 g |
| KI | 0.12 g |
| Antifoggant (2) | 0.10 g |
| Preservative (1) | 0.07 g |

TABLE 9

| Composition of Dye Solution | Addition Amount |
|---|---|
| Sensitizing Dye (2) | 0.18 g |
| Methanol | 18.7 cc |

Stabilizer (1)

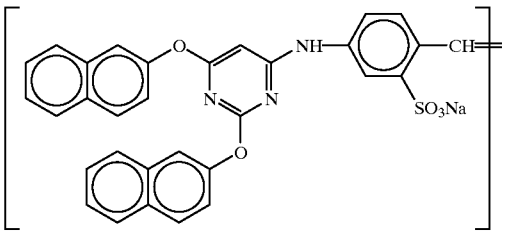

Stabilizer (2)

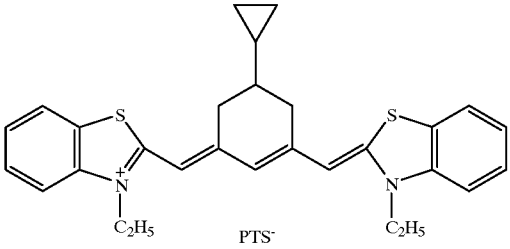

PTS: paratoluenesulfonic acid

Light-Sensitive Silver Halide Emulsion (3) (an emulsion for the first layer (810 nm light-sensitive layer)

Solutions I and II having the compositions shown in Table 11 were simultaneously added to the aqueous solution having the composition shown in Table 10 with thoroughly stirring over 30 minutes. Five minutes after the termination of the addition of Solution I, Solutions III and IV having the compositions shown in Table 11 were added to the above mixed solution over 24 minutes.

TABLE 10

| Composition | |
|---|---|
| $H_2O$ | 620 ml |
| Lime-processed gelatin | 20 g |
| KBr | 0.3 g |
| NaCl | 2 g |
| Silver halide solvent (1) | 0.030 g |
| Sulfuric acid (1N) | 15.5 ml |
| Temperature: 50° C. | |

TABLE 11

| | Solution (I) | Solution (II) | Solution (III) | Solution (VI) |
|---|---|---|---|---|
| $AgNO_3$ | 30.0 g | — | 70.0 g | — |
| KBr | — | 13.7g | — | 44.1 g |
| NaCl | — | 3.6g | — | 2.4 g |
| $K_2IrCl_6$ | — | — | — | 0.020mg |

TABLE 11-continued

| | Solution (I) | Solution (II) | Solution (III) | Solution (VI) |
|---|---|---|---|---|
| Yellow prussiate of potash | — | — | — | 0.04g |
| Total | Water to make 180 ml | Water to make 180 ml | Water to make 248 ml | Water to make 246 ml |

The above solution was washed and desalted (precipitant a was used at pH of 3.7) by ordinary methods, then 22 g of lime-processed ossein gelatin, and pH and pAg were adjusted to 7.4 and 7.8, respectively, and chemically sensitized at 60° C. Compounds used for chemical sensitization are shown in Table 12. The yield of the-thus obtained emulsion was 683 g. The emulsion was monodisperse cubic silver chlorobromide emulsion having a variation coefficient of 9.7%, an average grain size of 0.35 $\mu$m.

TABLE 12

| Compound used for chemical sensitization | Addition amount |
|---|---|
| 4-Hydroxy-6-methyl-1,3,3a,7-tetraazaindene | 0.25 g |
| Triethylthiourea | 1.98 mg |
| Antifoggant (2) | 0.16 g |
| Preservative (1) | 0.07 g |
| Preservative (2) | 3.00 g |

A method of preparing the gelatin dispersion of colloidal silver is described below.

The solution having the composition shown in Table 14 was added to the aqueous solution having the composition shown in Table 13 with thoroughly stirring over 4 minutes. Then, the reaction solution was washed using precipitant a, and 43 g of lime-processed ossein gelatin was added and pH was adjusted to 6.3. The yield of the-thus obtained dispersion was 512 g, and the average grain size was 0.02 $\mu$m. (The dispersion contained 2% of silver and 6.8% of gelatin.)

TABLE 13

| Composition | |
|---|---|
| $H_2O$ | 620 ml |
| Dextrin | 16 g |
| NaOH (5N) | 41 ml |
| Temperature: 30° C. | |

TABLE 14

| Composition | |
|---|---|
| $H_2O$ | 135 ml |
| $AgNO_3$ | 17 g |

A gelatin dispersion of hydrophobic additives is described below.

Gelatin dispersions of yellow dye-donating compound, magenta dye-donating compound, and cyan dye-donating compound were prepared according to the prescription shown in Table 15. That is, each oil phase component was dissolved by heating at about 70° C. to prepare a homogeneous solution. Liquid phase components heated at about 60° C. were added to the above solution and stirred and mixed. The solution was dispersed for 10 minutes with a homogenizer at 10,000 rpm. Water was added to the solution and stirred to obtain a homogeneous dispersion. Further, the ethyl acetate content of the gelatin dispersion of cyan dye-donating compound was reduced finally to 1/17.6 of the amount shown in Table 15 by repeating dilution and concentration using water with an ultrafiltration module (ultrafiltration module ACV-3050, a product of Asahi Chemical Industry Co., Ltd.).

TABLE 15

| | Composition of Dispersion | | |
|---|---|---|---|
| | Yellow Dispersion | Magenta Dispersion | Cyan Dispersion |
| Oil Phase | | | |
| Yellow dye-donating compound (1) | 9.5 g | — | — |
| Magenta dye-donating compound (1) | — | 13.6 g | — |
| Cyan dye-donating compound (1) | — | — | 15.4 g |
| Cyan dye-donating compound (2) | — | — | 1.8 g |
| Reducing agent (1) | 1.7 g | 0.2 g | 2.0 g |
| Antifoggant (3) | 0.2 g | — | 0.2 g |
| Antifoggant (4) | — | 0.7 g | — |
| Surfactant (1) | 1.1 g | 0.7 g | — |
| High boiling point organic solvent (1) | 4.7 g | — | 4.6 g |
| High boiling point organic solvent (2) | — | 10.2 g | 4.9 g |
| Development Accelerator (1) | 0.6 g | 2.1 g | — |
| Dye (a) | 1.1 g | — | 0.5 g |
| Water | 0.4 ml | — | — |
| Ethyl acetate | 10.7 ml | 25.1 ml | 53.3 ml |
| Liquid Phase | | | |
| Lime-processed gelatin | 10.0 g | 10.0 g | 10.0 g |
| Calcium sulfate | 0.1 g | 0.1 g | — |
| Surfactant (1) | — | — | 0.8 g |
| Carboxymethyl cellulose | — | — | 0.3 g |
| Water | 60.4 ml | 109 ml | 95.7 ml |
| Water was added after emulsified dispersion | 99.8 ml | 170 ml | 209 ml |
| Preservative (1) | 0.004 g | 0.004 g | 0.1 g |

A gelatin dispersion of Antifoggant (4) was prepared according to the prescription in Table 16. That is, oil phase components were dissolved by heating at about 60° C. Liquid phase components heated at about 60° C. were added to the above solution and stirred and mixed. The solution was dispersed for 10 minutes with a homogenizer at 10,000 rpm to prepare a homogeneous dispersion.

TABLE 16

| | Composition of Dispersion |
|---|---|
| Oil Phase | |
| Antifoggant (4) | 0.8 g |
| Reducing agent (1) | 0.1 g |
| High boiling point organic solvent (2) | 2.3 g |
| High boiling point organic solvent (5) | 0.2 g |
| Surfactant (1) | 0.5 g |
| Surfactant (4) | 0.5 g |
| Ethyl acetate | 10.0 ml |
| Liquid Phase | |
| Lime-processed gelatin | 10.0 g |
| Calcium nitrate | 0.1 g |

TABLE 16-continued

| | Composition of Dispersion |
|---|---|
| Preservative (1) | 0.004 g |
| Water | 45.2 ml |
| Water was added after emulsified dispersion | 35.0 ml |

A gelatin dispersion of High Boiling Point Organic Solvent (1) was prepared according to the prescription in Table 17 (Dispersions A and B). That is, oil phase components were dissolved by heating at about 60° C. Liquid phase components heated at about 60° C. were added to the above solution and stirred and mixed. The solution was dispersed for 10 minutes with a homogenizer at 10,000 rpm to prepare a homogeneous dispersion.

TABLE 17

| | Composition of Dispersion | |
|---|---|---|
| | Dispersion A | Dispersion B |
| Oil Phase | | |
| Magenta dye-donating compound (2) | 0.13 g | — |
| Reducing agent (2) | 0.07 g | — |
| High boiling point organic solvent (1) | 9.1 g | 9.1 g |
| High boiling point organic solvent (5) | 0.2 g | 0.2 g |
| Surfactant (1) | 0.5 g | 0.5 g |
| Surfactant (4) | 0.5 g | 0.5 g |
| Ethyl acetate | 10.0 g | 10.0 g |
| Liquid Phase | | |
| Lime-processed gelatin | 10.0 g | 10.0 g |
| Calcium nitrate | 0.1 g | 0.1 g |
| Preservative (1) | 0.004 g | 0.004 g |
| Water | 74.1 ml | 74.1 ml |
| Water was added after emulsified dispersion | 104.0 ml | 104.0 ml |

A gelatin dispersion of Reducing Agent (2) was prepared according to the prescription in Table 18. That is, oil phase components were dissolved by heating at about 60° C. Liquid phase components heated at about 60° C. were added to the above solution and stirred and mixed. The solution was dispersed for 10 minutes with a homogenizer at 10,000 rpm to prepare a homogeneous dispersion. Ethyl acetate was removed from the obtained dispersion using an apparatus for removing organic solvents under reduced pressure.

TABLE 18

| | Composition of Dispersion |
|---|---|
| Oil Phase | |
| Reducing agent (2) | 7.5 g |
| High boiling point organic solvent (1) | 4.7 g |
| Surfactant (1) | 1.9 g |
| Ethyl acetate | 14.4 ml |
| Liquid Phase | |
| Acid-processed gelatin | 10.0 g |
| Preservative (1) | 0.02 g |
| Preservative (2) | 0.04 g |
| Sodium hydrogensulfite | 0.1 g |
| Water | 136.7 ml |

Dispersions of Polymer Latex (a) was prepared according to the prescription shown in Table 19. That is, Polymer Latex (1) in the amount shown in Table 19, Surfactant (5), and water were mixed, Anionic Surfactant (6) was added thereto over 10 minutes while stirring the solution to obtain a homogeneous dispersion. Further, the salt content of the dispersion was reduced finally to 1/9 by repeating dilution and concentration using water with an ultrafiltration module (ultrafiltration module ACV-3050, a product of Asahi Chemical Industry Co., Ltd.).

TABLE 19

| | Composition of Dispersion |
|---|---|
| Aq. soln. of polymer latex (a) (solid content: 13%) | 108.0 ml |
| Surfactant (3) | 20.0 g |
| Aq. soln. of anionic surfactant (5%) | 600.0 ml |
| Water | 1,232.0 ml |

A gelatin dispersion of Stabilizer (a) was prepared according to the prescription in Table 20. That is, oil phase components were dissolved at room temperature. Liquid phase components heated at about 40° C. were added to the above solution and stirred and mixed. The solution was dispersed for 10 minutes with a homogenizer at 10,000 rpm. Water was added to the above solution and stirred to prepare a homogeneous dispersion.

TABLE 20

| | Composition of Dispersion |
|---|---|
| Oil Phase | |
| Stabilizer (1) | 4.0 g |
| Sodium Hydroxide | 0.3 g |
| Methanol | 62.8 g |
| Liquid Phase | |
| High boiling point organic solvent (4) | 0.9 g |
| Gelatin from which calcium was removed (Ca content: 100 ppm or less) | 10.0 g |

TABLE 20-continued

| | Composition of Dispersion |
|---|---|
| Preservative (1) | 0.04 g |
| Water | 320.5 ml |

A gelatin dispersion of zinc hydroxide was prepared according to the prescription in Table 22. That is, components were mixed and dissolved, then the solution was dispersed using glass beads having an average particle size of 0.75 mm with a mill for 30 minutes. Subsequently, glass beads were removed and a homogeneous dispersion was obtained. (Zinc hydroxide used had an average particle size of 0.25 $\mu$m.)

TABLE 21

| | Composition of Dispersion |
|---|---|
| Zinc hydroxide | 15.9 g |
| Carboxymethyl cellulose | 0.7 g |
| Sodium polyacrylate | 0.07 g |
| Lime-processed gelatin | 4.2 g |
| Water | 100 ml |
| High boiling point organic solvent (4) | 0.4 g |

A method of preparing a gelatin dispersion of a matting agent to be added to a protective layer. A solution of methylene chloride in which PMMA was dissolved was added to gelatin with a small amount of surfactant and stirred at high speed. Subsequently, methylene chloride was removed from the solution using an apparatus for removing a solvent under reduced pressure, and a homogeneous dispersion having an average particle size of 4.3 $\mu$m was obtained.

Cyan Dye-Donating Compound (1)

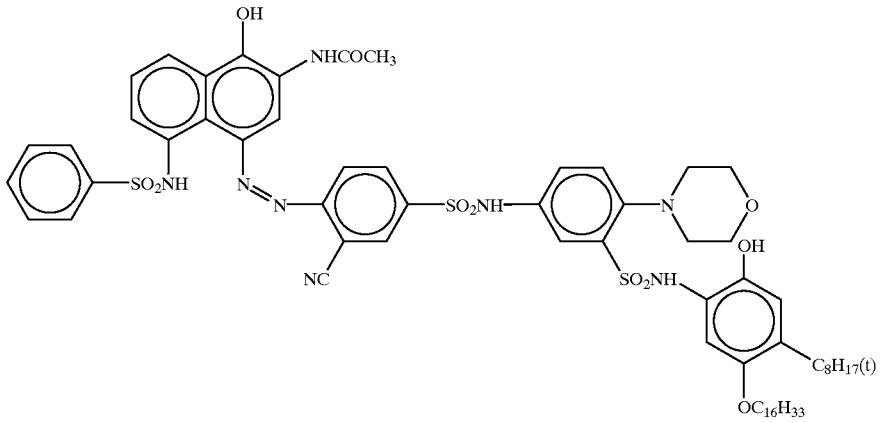

Cyan Dye-Donating Compound (2)
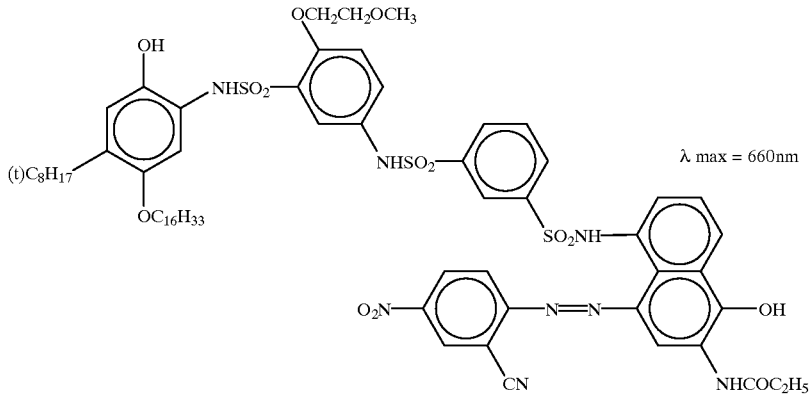
Dye (a)
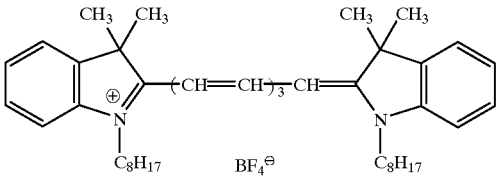
Magenta Dye-Donating Compound (1)
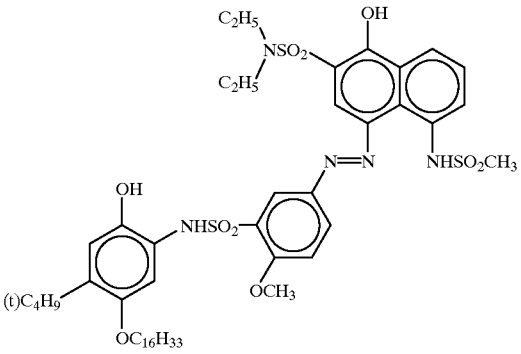
Yellow Dye-Donating Compound (1)
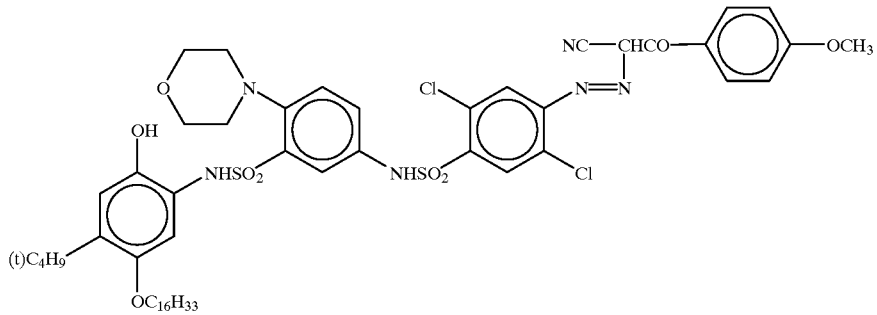
Reducing Agent (1)
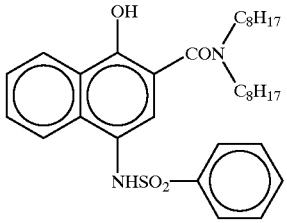
Antifoggant (3)
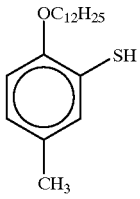

-continued
Antifoggant (4)
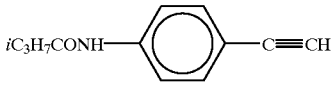
Surfactant (1)
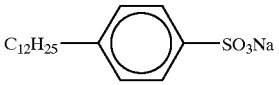
Development Accelerator (1)
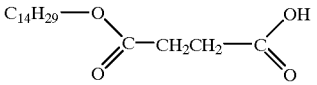
Development Accelerator (2)
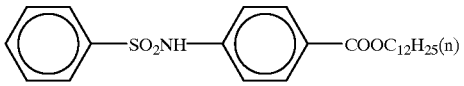
High Boiling Point Organic Solvent (1)
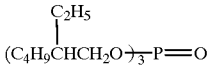
High Boiling Point Organic Solvent (2)
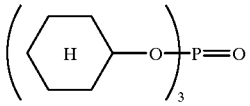
Preservative (3)
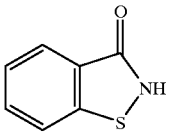
Magenta Dye-Donating Compound (2)
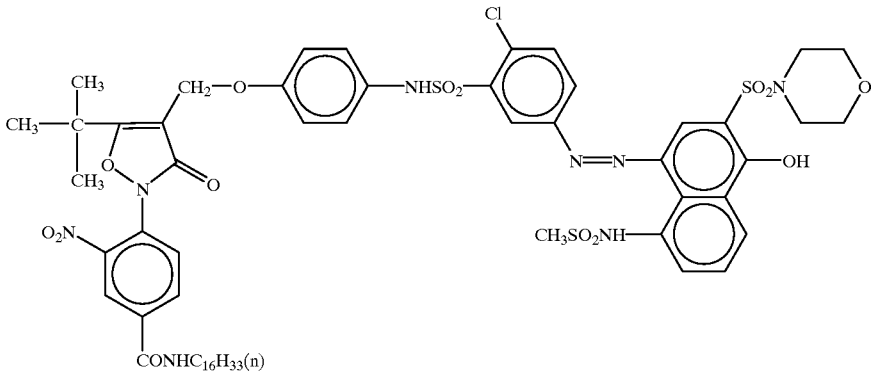
Reducing Agent (2)
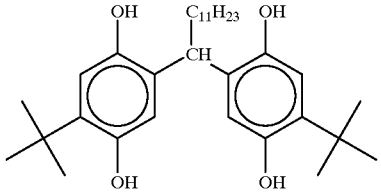
Preservative (4)
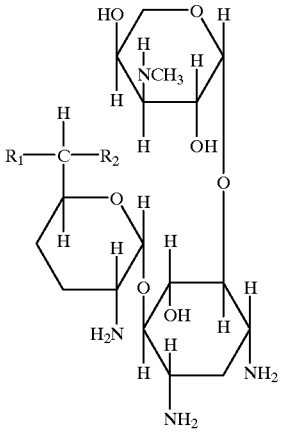
| | $R_1$ | $R_2$ |
|---|---|---|
| $C_1$ | $H_3C$— | —$NHCH_3$ |
| $C_2$ | $H_3C$— | —$NH_2$ |
| $C_{10}$ | H— | —$NH_2$ |
| $C_{20}$ | H— | —$NHCH_3$ |
Surfactant (2)
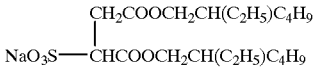
Surfactant (3)
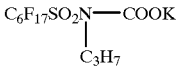

Water-Soluble Polymer (a)
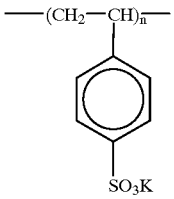
limiting viscosity number: [η]=1.6 (0.1 N, NaCl, 30° C.)
molecular weight≈1,000,000
Water-Soluble Polymer (b)
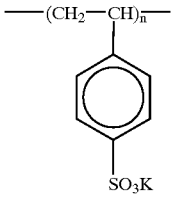
limiting viscosity number: [η]=0.8 (0.1 N, NaCl, 30° C.)
molecular weight≈400,000
Sensitizing Dye (3)
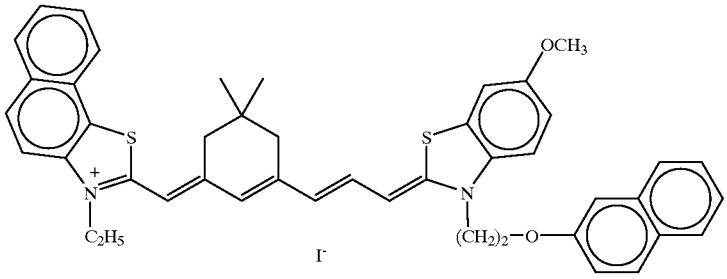
Hardening Agent (1)
$CH_2{=}CHSO_2CH_2SO_2CH{=}CH_2$
Surfactant (4)
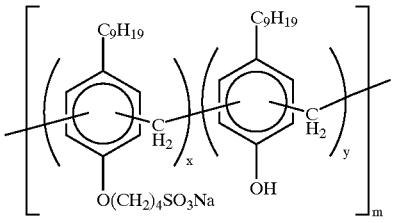
$x{:}y = 4{:}6$ $m \approx 6.8$
High Boiling Point Organic Solvent (4)
$C_{26}H_{46.9}Cl_{7.1}$
Empara 40 (a product of Ajinomoto Co., Ltd.)
Polymer Latex (a)

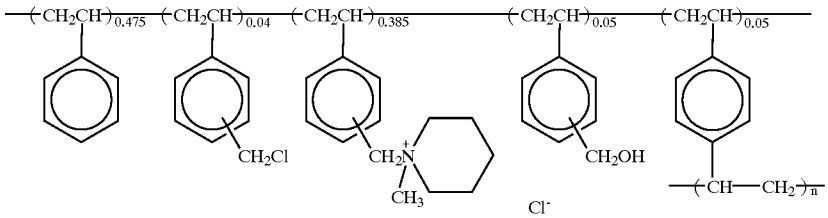

Surfactant (5)

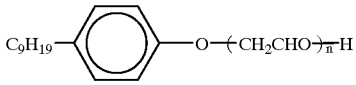

$n = 20$

Surfactant (6)

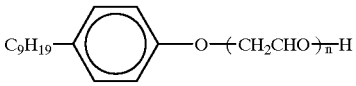

$n = 50$

Surfactant (7)

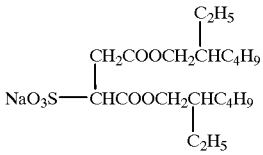

Heat Developable Color Photographic Material No. 101 shown in Tables 22 and 23 was prepared using the above substances.

TABLE 22

Main Constitutional Elements of Heat Developing Photographic Material No. 101

| | Coating Amount ($mg/m^2$) |
|---|---|
| Seventh Layer (protective layer) | |
| Acid-processed gelatin | 843 |
| Reducing agent (2) | 47 |
| High boiling point organic solvent (1) | 30 |
| Colloidal silver grain | 2 |
| Matting agent (PMMA resin) | 17 |
| Surfactant (2) | 0.2 |
| Surfactant (1) | 12 |
| Surfactant (3) | 1.6 |
| Polymer latex (a) | 30 |
| Surfactant (6) | 19 |
| Surfactant (7) | 25 |
| Sixth Layer (interlayer) | |
| Lime-processed gelatin | 668 |
| Antifoggant | 12 |
| Reducing agent (1) | 1.5 |
| High boiling point organic solvent (2) | 35 |
| High boiling point organic solvent (5) | 3.5 |
| Surfactant (1) | 7.2 |

TABLE 22-continued

Main Constitutional Elements of Heat Developing Photographic Material No. 101

| | Coating Amount ($mg/m^2$) |
|---|---|
| Surfactant (4) | 7.2 |
| Surfactant (5) | 48 |
| Zinc hydroxide | 373 |
| Water-soluble polymer (a) | 7.2 |
| Calcium nitrate | 13 |
| Fifth Layer (red-sensitive layer) | |
| Lime-processed gelatin | 451 |
| Light-sensitive silver halide emulsion (1) as silver | 299 |
| Magenta dye-donating compound (1) | 410 |
| High boiling point organic solvent (2) | 308 |
| Reducing agent (1) | 6 |
| Development accelerator (1) | 64 |
| Antifoggant (4) | 20 |
| Surfactant (1) | 22 |
| Water-soluble polymer (a) | 8.2 |
| Calcium nitrate | 4.2 |
| Fourth Layer (interlayer) | |
| Lime-processed gelatin | 669 |
| Antifoggant (4) | 12 |
| Reducing agent (1) | 1.5 |
| High boiling point organic solvent (2) | 35 |
| High boiling point organic solvent (5) | 3.5 |
| Surfactant (1) | 7.2 |
| Surfactant (4) | 7.2 |
| Surfactant (5) | 49 |
| Zinc hydroxide | 374 |
| Water-soluble polymer (a) | 7.2 |
| Calcium nitrate | 13 |
| Third Layer (second infrared-sensitive layer) | |
| Lime-processed gelatin | 391 |
| Light-sensitive silver halide emulsion (2) as silver | 134 |
| Stabilizer (1) | 7.3 |
| Cyan dye-donating compound (1) | 351 |
| Cyan dye-donating compound (2) | 40 |
| Dye (a) | 11 |
| High boiling point organic solvent (1) | 105 |
| High boiling point organic solvent (2) | 112 |
| Reducing agent (1) | 46 |
| Antifoggant (3) | 4.8 |
| Surfactant (1) | 12 |
| Carboxymethyl cellulose | 5.8 |
| Water-soluble polymer (a) | 12 |
| Second Layer (interlayer) | |
| Lime-processed gelatin | 526 |
| Magenta dye-donating compound (2)* | 1.8 |
| Reducing agent (2) | 0.93 |
| High boiling point organic solvent (1) | 128 |
| High boiling point organic solvent (5) | 3.2 |
| Surfactant (1) | 6.6 |
| Surfactant (4)* | 6.6 |
| Surfactant (5) | 17 |

TABLE 22-continued

| Main Constitutional Elements of Heat Developing Photographic Material No. 101 | Coating Amount ($mg/m^2$) |
|---|---|
| Antifoggant (5) | 3.4 |
| Water-soluble polymer (b) | 26 |
| Calcium nitrate | 12 |
| First Layer (red-sensitive layer) | |
| Lime-processed gelatin | 629 |
| Light-sensitive silver halide emulsion (3) as silver | 331 |
| Stabilizer (1) | 18 |
| Yellow dye-donating compound (1) | 396 |
| Sensitizing dye (3) | 0.12 |
| Dye (a) | 46 |
| High boiling point organic solvent (1) | 198 |
| Reducing agent (1) | 71 |
| Development accelerator (1) | 25 |
| Antifoggant (3) | 6.8 |
| Surfactant (1) | 45 |

TABLE 22-continued

| Main Constitutional Elements of Heat Developing Photographic Material No. 101 | Coating Amount ($mg/m^2$) |
|---|---|
| Water-soluble polymer (b) | 42 |
| Hardening agent (1) | 59 |

Note) *-*: Dispersion A

Heat Developable Color Photographic Material Nos. 102 to 104 were prepared as comparative samples. These materials were prepared in the same manner as the preparation of Heat Developable Color Photographic Material No. 101 except that each dye-donating compound in the dispersion of dye-donating compound shown in Table 15 and each dispersion shown in Table 17 were replaced with the compounds and amounts shown in Table 24.

TABLE 24

| Heat Developing Color Photographic Material No. | Cyan Dye-Donating Compound | Magenta Dye-Donating Compound | Yellow Dye-Donating Compound | Dispersion |
|---|---|---|---|---|
| 101 | Cyan dye-donating compound (1) (15.2 g) Cyan dye-donating compound (2) (1.8 g) | Magenta dye-donating compound (1) (16.8 g) | yellow dye-donating compound (1) (8.5 g) | A |
| 102 | Cyan dye-donating compound (1) (15.2 g) Cyan dye-donating compound (2) (1.8 g) | Magenta dye-donating compound (1) (16.8 g) | Yellow dye-donating compound (1) (8.5 g) | B |
| 103 | Cyan dye-donating compound (4) (16.5 g) Cyan dye-donating compound (2) (1.8 g) | Magenta dye-donating compound (1) (16.8 g) | Yellow dye-donating compound (1) (8.5 g) | B |
| 104 | Cyan dye-donating compound (4) (8.3 g) Cyan dye-donating compound (2) (9.9 g) | Magenta dye-donating compound (1) (16.8 g) | Yellow dye-donating compound (1) (8.5 g) | B |

Numerals in parentheses indicate the addition amount of each dye-donating compound to prepare a dispersion of dye-donating compound.

Cyan Dye-Donating Compound (4)

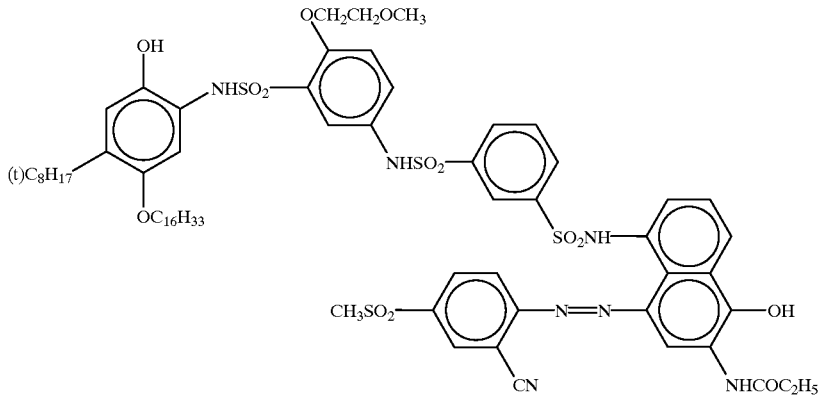

λ max = 623nm

Photographic Material Nos. 101 to 104 were respectively combined with Image-Receiving Material M-101 and image output was conducted using digital color printer Fujix Pictrography PG-3000 (a product of Fuji Photo Film Co., Ltd.) by standard conditions. The outputted images were a plurality of standard color charts (proofs) of from 250 to 2,000 colors for printing. Color matching was carried out using this color chart according to color conversion method 3. described above.

After color matching, standard color chart for printing was again outputted and color hues of standard color chart for printing and standard color chart outputted by PG-3000 were evaluated. Color difference of each color patch of respective color charts was visually judged. A color patch having no color difference was graded o and having color difference was graded x. The results obtained are shown in Table 25.

Moreover, white ground of each sample was measured using GRETAG spectrophotometer (SPM-100II) and whiteness preferred for printing was graded o and not preferred was x. The results obtained are shown in Table 25.

Figure 2:
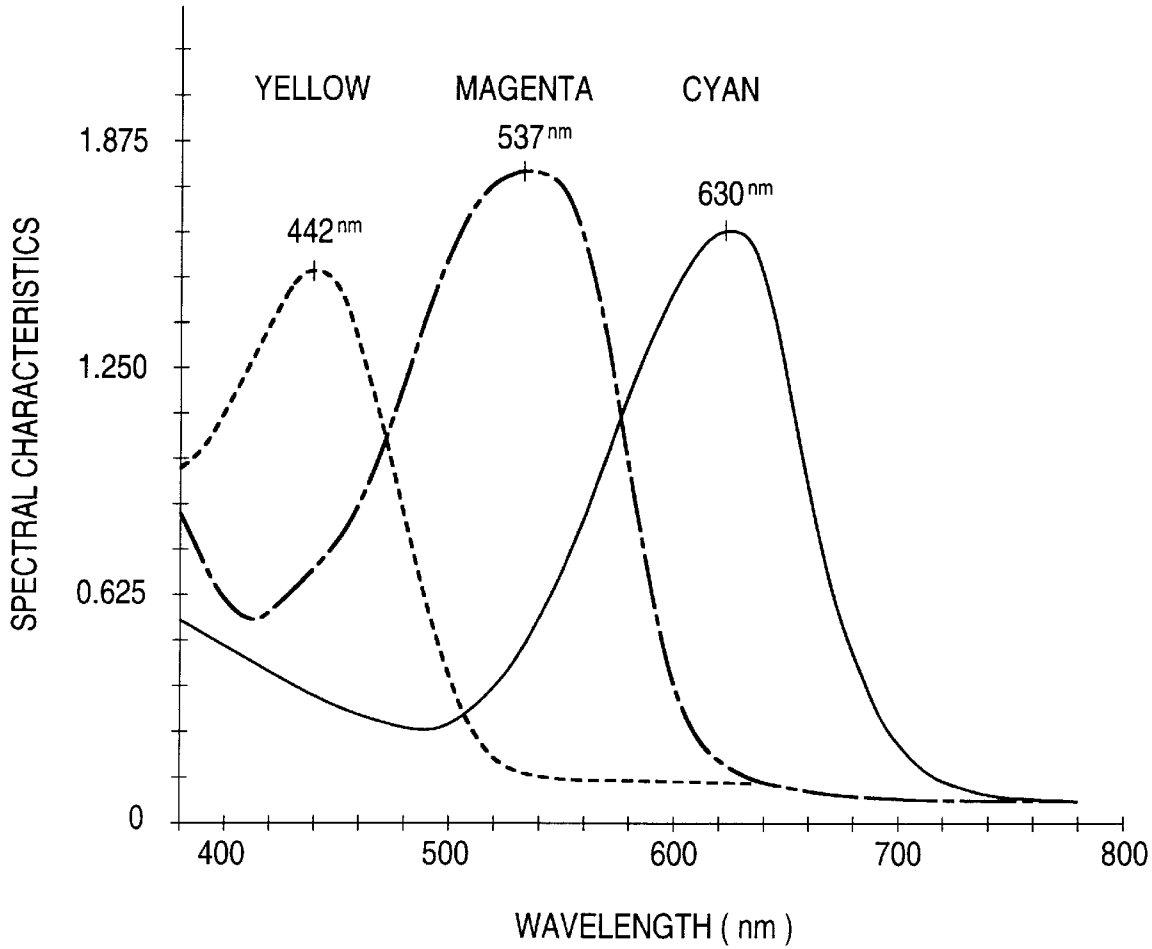
FIG. 2 is a drawing showing spectral characteristics of the dye transferred to Image-Receiving Material M-101 according to the present invention.

Further, in combination of No. 1 in Table 25, spectral characteristics of the dye transferred to Image-Receiving Material M-101 are shown in FIG. 2.

Moreover, the gloss of Sample No. 1 according to the present invention was determined using a digital deformation glossimeter UGV-5D (a product of Suga Testing Machine Co., Ltd.), by the conditions of incident angle at 20°, light reception angle at 20°, aperture of 8 mm square as a throttle plate for a light source part, and others are by the prescribed conditions.

As a result, the gloss of Sample No. 1 was 10, therefore, the texture nearer to the printed matter could be obtained.

A comparative sample Image-Receiving Material M-201 was prepared by excluding Matting Agent (3) in the first layer and Matting Agent (2) in the fifth layer from Image-Receiving Material M-101.

Image-Receiving Material M-201 was combined with Heat Developable Color Photographic Material No. 101 and processed in the same manner.

The gloss of Image-Receiving Material M-201 after processing was 60, which is considerably different from the texture of the printed matter. Therefore, it is understood that the combination of the photographic material and the image-receiving material according to the present invention is particularly excellent.

TABLE 25

| No. | Remarks | Image-Receiving Material | Heat Developing Color Photographic Material | Dye-Donating Compound Y | Dye-Donating Compound M | Dye-Donating Compound Cy | Y | M | Cy | Tint (by visual judgement, comparison with std. color chart for printing) (L = 60) | Results of Evaluation L | a* | b* | Evaluation |
|---|---|---|---|---|---|---|---|---|---|---|---|---|---|---|
| 1 | Invention (Example) | M-101 | 101 | Y (1) | M (1) | C (1) C (2) | 442 | 537 | 630 | ○ | 93.3 | 0.1 | 1.3 | ○ |
| 2 | Comparison | M-101 | 102 | Y (1) | M (1) | C (1) C (2) | 442 | 537 | 630 | ○ | 93.5 | −2.1 | 2.1 | x |
| 3 | Comparison | M-101 | 103 | Y (1) | M (1) | C (4) C (2) | 442 | 537 | 625 | ○ | 93.4 | −2.4 | 1.6 | x |
| 4 | Comparison | M-101 | 104 | Y (1) | M (1) | C (4) C (2) | 442 | 537 | 642 | x | 93.1 | −2.8 | 1.1 | x |

*Standard color chart for printing was a chart in which Toyo High Plus Ink was used.

It is apparent from the results in Table 25 that the color difference is not observed between the photographic material of the present invention and the print and further the photographic material of the present invention has ideal properties as a color-proof for print correction such as exhibiting excellent whiteness.

Present invention can provide a heat developable color photographic material which can produce an image which is less in color difference from an image obtained using standard printing ink and also produce an image having good whiteness as a color-proof for printing (an image having a texture nearer to the printed matter), and an image-forming system using the same.

While the invention has been described in detail and with reference to specific examples thereof, it will be apparent to one skilled in the art that various changes and modifications can be made therein without departing from the spirit and scope thereof.

What is claimed is:

1. A heat developable color photographic material for use in an image-forming process comprising:

(a) superposing a heat developable color photographic material onto an image-receiving material that is formed on a separate support from a support of the heat developable color photographic material; and (b) heat-developing said heat developable color photographic material superposed on said image-receiving material to form or release a diffusible dye, so that the diffusible dye is transferred to said image-receiving material to thereby form an image, wherein said heat developable color photographic material contains at least a light-sensitive silver halide and yellow, magenta and cyan dye-donating compounds which form or release diffusible yellow, magenta and cyan dyes, respectively, by heat development corresponding to silver development, wherein said yellow dye has a maximum absorption intensity of spectral absorption at a wavelength of from 440 nm to 460 nm, said magenta dye has a maximum absorption intensity of spectral absorption at a wavelength of from 525 nm to 545 nm, and said cyan dye has a maximum absorption intensity of spectral absorption at a wavelength of from 610 nm to 640 nm, and wherein said heat developable color photographic material further contains at least one compound represented by the following formula (I) other than said dye-donating compounds:

(I)

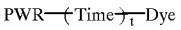

wherein PWR represents a group which releases $-(\text{Time})_t\text{Dye}$ upon reduction; Time represents a group which releases Dye via a subsequent reaction after being released as $-(\text{Time})_t\text{Dye}$; t represents an integer of 0 or 1; and Dye represents a dye or a dye in a form of shortwave temporarily shifted which can restore colors at development.

2. The heat developable color photographic material according to claim 1, wherein said compound represented by formula (I) is a compound represented by the following formula (II):

(II)

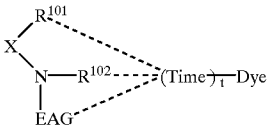

wherein

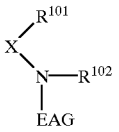

corresponds to PWR;

Time, t and Dye are the same as those defined in formula (I), respectively;

is bonded to one of $R^{101}$, $R^{102}$ and EAG; EAG represents a group accepting an electron from a reduced substance and is bonded to a nitrogen atom; X represents a group containing an oxygen atom (—O—), a sulfur atom (—S—), or a nitrogen-containing group (—N($R^{103}$)—); and $R^{101}$, $R^{102}$ and $R^{103}$ each represents a substituent other than a hydrogen atom or a single bond, which may be bonded to each other to form a 5- to 8-membered ring.

3. The heat developable color photographic material according to claim 2, wherein $R^{101}$, $R^{102}$ and $R^{103}$ each is a substituted or unsubstituted alkyl, aralkyl, alkenyl, alkynyl, aryl, heterocyclic, sulfonyl, carbamoyl or sulfamoyl group.

4. The heat developable color photographic material according to claim 2, wherein X is an oxygen atom.

5. The heat developable color photographic material according to claim 2, wherein EAG is a group represented by the following formula (A):

(A)

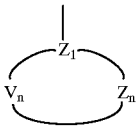

wherein $Z_1$ represents

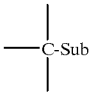

or

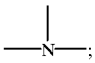

$V_n$ represents an atomic group to form a 3- to 8-membered aromatic ring together with $Z_1$ and $Z_2$; n represents an integer of from 3 to 8; $V_3$ means $-Z_3-$, $V_4$ means $-Z_3-Z_4-$, $V_5$ means $-Z_3-Z_4-Z_5-$, $V_6$ means $-Z_3-Z_4-Z_5-Z_6-$, $V_7$ means $-Z_3-Z_4-Z_5-Z_6-Z_7-$, and $V_8$ means $-Z_3-Z_4-Z_5-Z_6-Z_7-Z_8-$;

$Z_2$ to $Z_8$ each represents

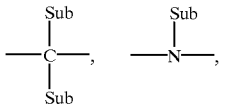

—O—, —S— or —$SO_2$—;

and Sub represents a single bond (a π-bond), a hydrogen atom, or a substituent selected so that the sum of the Hammett's substituent constant $\sigma_p$ value becomes +0.5 or more, provided that a plurality of Sub's may be the same or different, or they may be bonded to each other to form a 3- to 8-membered saturated or unsaturated carbon ring or a heterocyclic ring.

6. The heat developable color photographic material according to claim 2, wherein said compound represented by formula (II) has a ballast group having 8 or more carbon atoms at the position of EAG, $R^{101}$, $R^{102}{}_1$, $R^{103}$ or X.

7. The heat developable color photographic material according to claim 1, wherein the amount of said compound represented by formula (I) present in said heat developable photographic material is from 0.05 to 5 mg/$m^2$.

8. The heat developable color photographic material according to claim 1, having at least three silver halide emulsion layers each having light sensitivity in a spectral region different from each other.

9. The heat developable color photographic material according to claim 1, wherein said dye or the said dye in a form of shortwave temporarily shifted which can restore colors at development is an azo dye, an azomethine dye, an anthraquinone dye, a naphthoquinone dye, a styryl dye, a nitro dye, a quinoline dye, a carbonyl dye or a phthalocyanine dye.

10. The heat developable color photographic material according to claim 1, wherein the amount of said compound represented by formula (I) present in said heat developable photographic material is from 0.1 to 3 mg/$m^2$.

11. An image-forming system comprising:

a heat developable color photographic material;

an image-receiving material that is formed on a separate support from a support of the heat developable color photographic material, and on which said heat developable color photographic material is to be superposed;

means for heat-developing said heat developable color photographic material superposed on the image-receiving material to form or release a diffusible dye, so that the diffusible dye is transferred to said image-receiving material to thereby form an image, wherein said heat developable color photographic material contains at least a light-sensitive silver halide and yellow, magenta and cyan dye-donating compounds which form or release diffusible yellow, magenta and cyan dyes, respectively, by heat development corresponding to silver development, wherein said yellow dye has a maximum absorption intensity of spectral absorption at a wavelength of from 440 nm to 460 nm, said magenta dye has a maximum absorption intensity of spectral absorption at a wavelength of from 525 nm to 545 nm, and said cyan dye has a maximum absorption intensity of spectral absorption at a wavelength of from 610 nm to 640 nm, and wherein said heat developable color photographic material further contains at least one compound represented by the following formula (I) other than said dye-donating compounds:

$$\mathrm{PWR}\text{—}(\mathrm{Time})_t\text{—}\mathrm{Dye} \qquad \text{(I)}$$

wherein PWR represents a group which releases —(Time)$_t$Dye upon reduction; Time represents a group which releases Dye via a subsequent reaction after being released as —(Time)$_t$Dye; t represents an integer of 0 or 1; and Dye represents a dye or a dye in a form of shortwave temporarily shifted which can restore colors at development.

* * * * *